US012258724B2

(12) United States Patent
Ono et al.

(10) Patent No.: US 12,258,724 B2
(45) Date of Patent: Mar. 25, 2025

(54) PILE PRESS-IN CONSTRUCTION METHOD, PILE SUPPLYING DEVICE, AND PILE PRESS-IN DEVICE

(71) Applicant: GIKEN LTD., Kochi (JP)

(72) Inventors: Masaaki Ono, Kochi (JP); Toshihiko Murata, Kochi (JP); Yasuhiro Tanaka, Kochi (JP); Yoshihiro Morioka, Kochi (JP)

(73) Assignee: GIKEN LTD., Kochi (JP)

( * ) Notice: Subject to any disclaimer, the term of this patent is extended or adjusted under 35 U.S.C. 154(b) by 0 days.

(21) Appl. No.: 18/576,074

(22) PCT Filed: Jul. 1, 2022

(86) PCT No.: PCT/JP2022/026452
§ 371 (c)(1),
(2) Date: Jan. 2, 2024

(87) PCT Pub. No.: WO2023/282201
PCT Pub. Date: Jan. 12, 2023

(65) Prior Publication Data

US 2024/0263416 A1 Aug. 8, 2024

(30) Foreign Application Priority Data

Jul. 5, 2021 (JP) ..... 2021-111181

(51) Int. Cl.
*E02D 5/04* (2006.01)
*E02D 5/52* (2006.01)
(Continued)

(52) U.S. Cl.
CPC ..... *E02D 7/20* (2013.01); *E02D 5/523* (2013.01); *E02D 13/00* (2013.01); *E02D 2600/10* (2013.01)

(58) Field of Classification Search
CPC .. E02D 7/20; E02D 7/18; E02D 27/48; E02D 7/00; E02D 7/02; E02D 7/10;
(Continued)

(56) References Cited

U.S. PATENT DOCUMENTS 3,992,890 A * 11/1976 Pryke ..... E02D 7/20 405/232
5,006,015 A * 4/1991 Stephens ..... E02D 7/20 405/230
(Continued)

FOREIGN PATENT DOCUMENTS

GB 2448613 A * 10/2008 ..... E02D 11/00
JP S61-250231 A 11/1986
(Continued)

OTHER PUBLICATIONS

Sep. 13, 2022 International Search Report issued in International Patent Application No. PCT/JP2022/026452.
(Continued)

*Primary Examiner* — Edwin J Toledo-Duran
(74) *Attorney, Agent, or Firm* — Oliff PLC

(57) ABSTRACT

A pile press-in construction method uses a pile press-in device having a saddle, a clamp device grasping a top of an existing pile, a mast, a raising and lowering device, and a chuck device supported by the mast and holding a pile. The pile press-in device generates a reaction force by griping the existing pile with the clamp device, holds the pile by the chuck device, presses the pile into the ground by the raising and lowering device, and successively presses piles in while moving on a pile row including the existing pile to thereby extend the pile row. By turning of the mast and tilting of the chuck device about a chuck tilting axis, the chuck device is laid sideways and projects outward to a side of the pile row,
(Continued)

the pile is supplied and inserted into the chuck device, and the chuck device grasps the pile.

8 Claims, 14 Drawing Sheets

(51) Int. Cl.
*E02D 7/20* (2006.01)
*E02D 13/00* (2006.01)

(58) Field of Classification Search
CPC ..... E02D 13/00; E02D 27/34; E02D 27/16; E02D 5/74; E02D 27/01; E02D 5/24; E02D 31/10; E02D 5/22; E02D 3/054; E02D 5/00; E02D 15/08; E02D 9/00; E02D 35/005; E02D 5/02; E02D 5/68; E02D 27/30; E02D 29/00; E02D 3/074; E02D 5/03; E02D 5/187; E02D 7/22; E02D 7/14; E02D 7/26; E02D 2250/0038; E02D 11/00; E02D 5/523; E02D 2600/10; E02D 5/04; E02D 13/04; E02D 13/02; E02D 2600/20; E21B 31/03; C09K 8/32
See application file for complete search history.

(56) References Cited

U.S. PATENT DOCUMENTS 5,135,335 A * 8/1992 Stephens ..... E02D 35/00 405/230
5,213,166 A * 5/1993 Watanabe ..... E02D 11/00 173/1
5,257,667 A * 11/1993 Sano ..... E02D 11/00 173/128
6,073,704 A * 6/2000 Yasuoka ..... E02D 13/02 173/32
11,530,520 B2 * 12/2022 Kitamura ..... E02D 7/20
2003/0044241 A1 * 3/2003 Mure ..... E02D 33/00 405/231
2004/0261571 A1 * 12/2004 Fukuchi ..... E02F 9/22 74/730.1
2005/0086790 A1 * 4/2005 Kitamura ..... E02D 13/02 29/715
2006/0198706 A1 * 9/2006 Neville ..... E02D 5/56 405/252.1
2011/0064526 A1 * 3/2011 White ..... E02D 5/38 405/245
2016/0362864 A1 * 12/2016 Thurner ..... E02D 5/28
2019/0162211 A1 * 5/2019 Lyytikäinen ..... E02D 7/14
2020/0087883 A1 * 3/2020 Kitamura ..... E02D 7/20
2020/0149241 A1 * 5/2020 Flanigan ..... E02D 13/00
2021/0010219 A1 * 1/2021 Kim ..... E02D 5/58
2021/0047009 A1 * 2/2021 Roodenburg ..... E02D 13/04
2024/0263416 A1 * 8/2024 Ono ..... E02D 13/04

FOREIGN PATENT DOCUMENTS

JP H06193065 A * 7/1994
JP H02282514 A * 1/1995
JP H11-200368 A 7/1999
JP 2003-213686 A 7/2003
JP 2005-264647 A 9/2005
JP 4150521 B2 * 9/2008
JP 2010-196394 A 9/2010
JP 2011-001719 A 1/2011
JP 2011226209 A * 11/2011
JP 2020-090795 A 6/2020
JP 2020-148042 A 9/2020

OTHER PUBLICATIONS

Oct. 1, 2024 Extended European Search Report issued in European Application No. 22837617.4.

* cited by examiner

PILE PRESS-IN CONSTRUCTION METHOD, PILE SUPPLYING DEVICE, AND PILE PRESS-IN DEVICE

TECHNICAL FIELD

The present invention relates to a pile press-in construction method, a pile supplying device, and a pile press-in device.

BACKGROUND ART

Heretofore, there is usage of a pile press-in device provided with a saddle, a clamp device that is provided at the bottom of the saddle and grasps an upper end of existing piles which have been pressed into the ground, a mast erected in a turnable manner on the saddle, a raising and lowering device, and a chuck device that is supported by the mast via the raising and lowering device and holds a pile.

The pile press-in device generates a reaction force by using the clamp device to grip the upper end of the existing piles which have been pressed into the ground, holds the pile by the chuck device, presses the pile into the ground using an operation by the raising and lowering device, and successively presses in piles while moving on a pile row formed by the existing piles to thereby extend the pile row on the ground.

In this case, a crane or the like is used to supply a pile to the chuck device.

In the invention described in Patent Document 1, a chuck device is provided in a manner that enables the chuck device to tilt rearward, and it is possible to, in a state where an end of a pile supplied in a laid-sideways state is held by the chuck device that has been tilted rearward, tilt the chuck device to thereby erect the pile.

CITATION LIST

Patent Literature

Patent Document 1: JP 2020-148042A

SUMMARY OF INVENTION

Technical Problem

However, in areas having a height limitation such as bridge girder, when using the abovementioned pile press-in device to press in a pile, there are cases where it is not possible to use a crane to supply a pile to the chuck device. In addition, due to the relation between the height limitation and the length of the pile, there are situations where it is not even possible to insert the pile into the chuck device from above.

In the invention described in Patent Document 1, the chuck device grips the tip of a pile that is lying on a pile press-in device and then tilts by 90 degrees without further modification to erect the pile. Therefore, the positions of the pile and the chuck device when inserting the pile into the chuck device are high, and the position of a rotation center when erecting the pile is also high. Accordingly, even when employing a construction method that successively supplies short piles, joins a plurality of piles together in a longitudinal direction, and presses in the plurality of piles, at a site having a lower height limitation, consideration can be given to a situation where it is not possible to introduce the pile press-in device, such as a situation where the chuck device tilting backward would interfere with a bridge girder, for example, and there is a risk that it would not be possible to use the pile press-in device.

The present invention is made in the light of the above problem in the prior art, and addresses the problem of increasing the utility of a pile press-in device in areas having lower height limitations.

Solution to Problem

One aspect of the present invention for solving the above problem is a pile press-in construction method using a pile press-in device that is provided with a saddle, a clamp device that is provided at the bottom of the saddle and grasps an upper end of an existing pile that has been pressed into the ground, a mast erected in a turnable manner on the saddle, a raising and lowering device, and a chuck device that is supported by the mast via the raising and lowering device and holds a pile, the pile press-in device generating a reaction force by griping, with the clamp device, the upper end of the existing pile that has been pressed into the ground, holding the pile by the chuck device, pressing the pile into the ground by operating the raising and lowering device, and successively pressing in piles while moving on a pile row including the existing pile to thereby extend the pile row on the ground, the pile press-in construction method including:

employing, as the pile press-in device, a pile press-in device in which the chuck device is tiltable about a chuck tilting axis that intersects with the mast and is in a direction in which the mast and the chuck device line up; and pile supplying including causing the chuck device to be laid sideways and to project outward to a side of the pile row as viewed from an axial direction of the existing pile by turning the mast and tilting the chuck device, laying the pile sideways, supplying the pile, inserting the pile into the chuck device, and causing the chuck device to grasp the pile.

Another aspect of the present invention is a pile supplying device that supplies a pile to a chuck device of a pile press-in device, the pile press-in device generating a reaction force by gripping an upper end of an existing pile, grasping the pile by the chuck device, and pressing the pile into the ground, the chuck device being movable up and down, the pile supplying device including:

a pickup arm that picks up and moves the pile in a laid-sideways state, wherein a fork capable of picking up, raising, and lowering the pile is provided at a tip of the pickup arm.

Another aspect of the present invention is a pile press-in device, including:

the pile supplying device;

a saddle; a clamp device that is provided at a bottom of the saddle and grasps an upper end of an existing pile that has been pressed into the ground; a mast erected in a turnable manner on the saddle; a raising and lowering device; and a chuck device that is supported by the mast via the raising and lowering device and holds a pile, wherein a base end of the pickup arm is secured to the saddle, and the chuck device is tiltable about a chuck tilting axis that intersects with the mast and is in a direction in which the mast and the chuck device line up.

Advantageous Effects of Invention

By virtue of the present invention, it is possible to increase the utility of a pile press-in device in areas with lower height limitations.

DESCRIPTION OF EMBODIMENTS

Hereinafter, one embodiment of the present invention will be described with reference to the drawings. The following is one embodiment of the present invention and does not limit the present invention.

[Performing Pile Press-In Construction Method (1)]

Figure 5A:
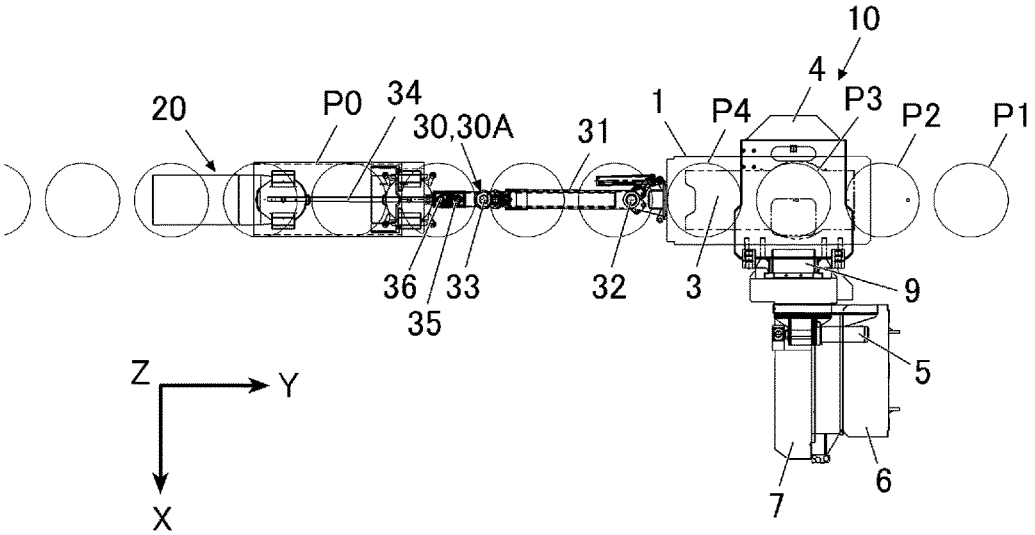
FIG. 5A This is a plan view that illustrates a situation for performing the pile press-in construction method at a site having height limitations.
Figure 5B:
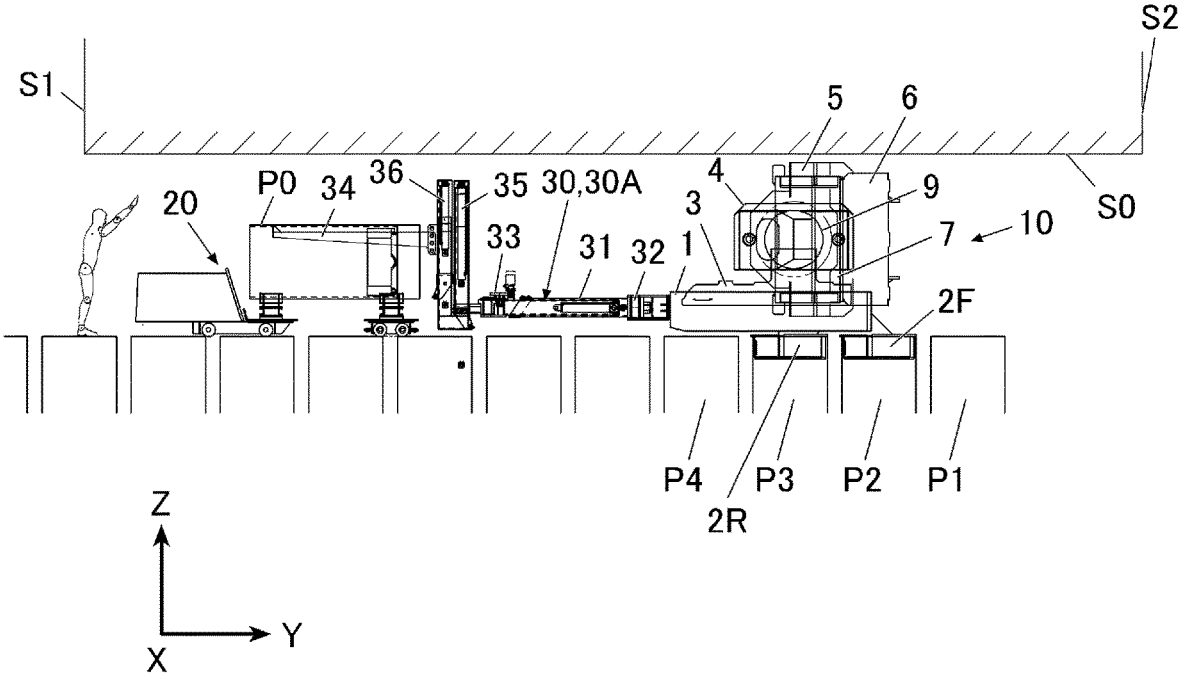
FIG. 5B This is a side surface view of FIG. 5A.
Figure 6A:
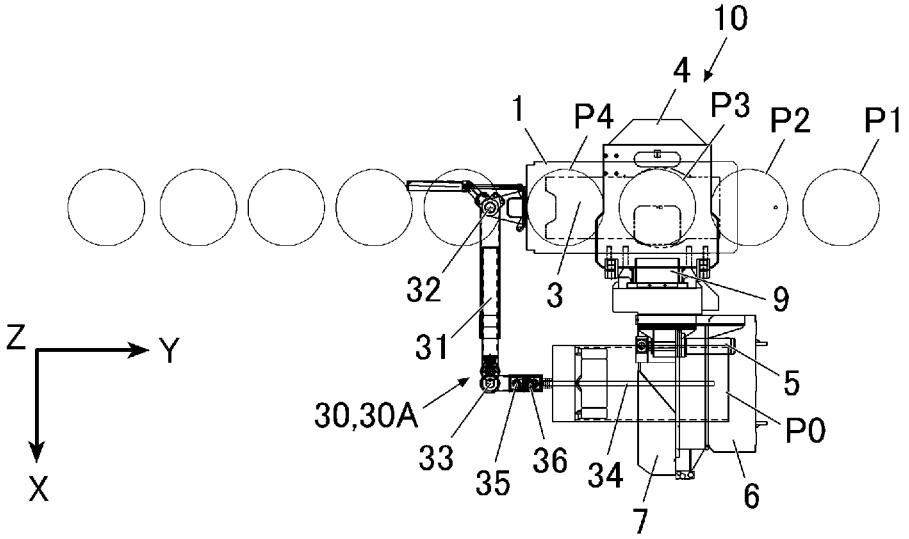
FIG. 6A This is a plan view illustrating a scene that has progressed from FIG. 5A.
Figure 6B:
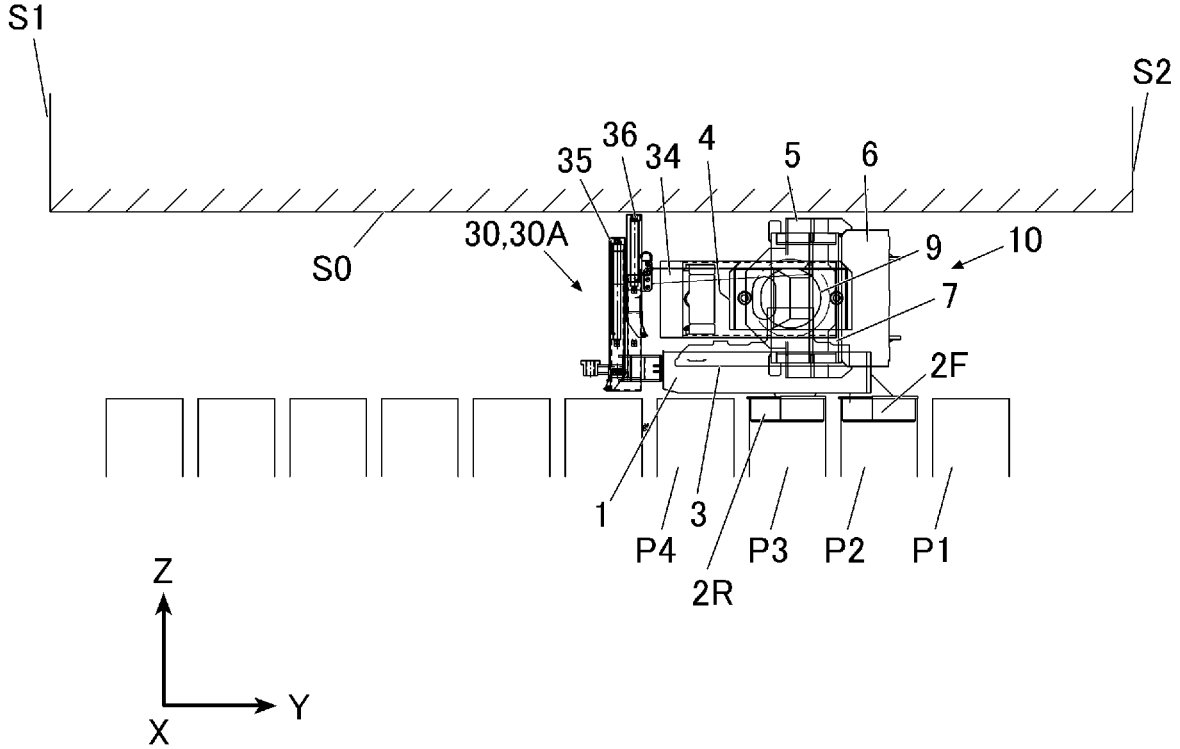
FIG. 6B This is a side surface view of FIG. 6A.
Figure 7A:
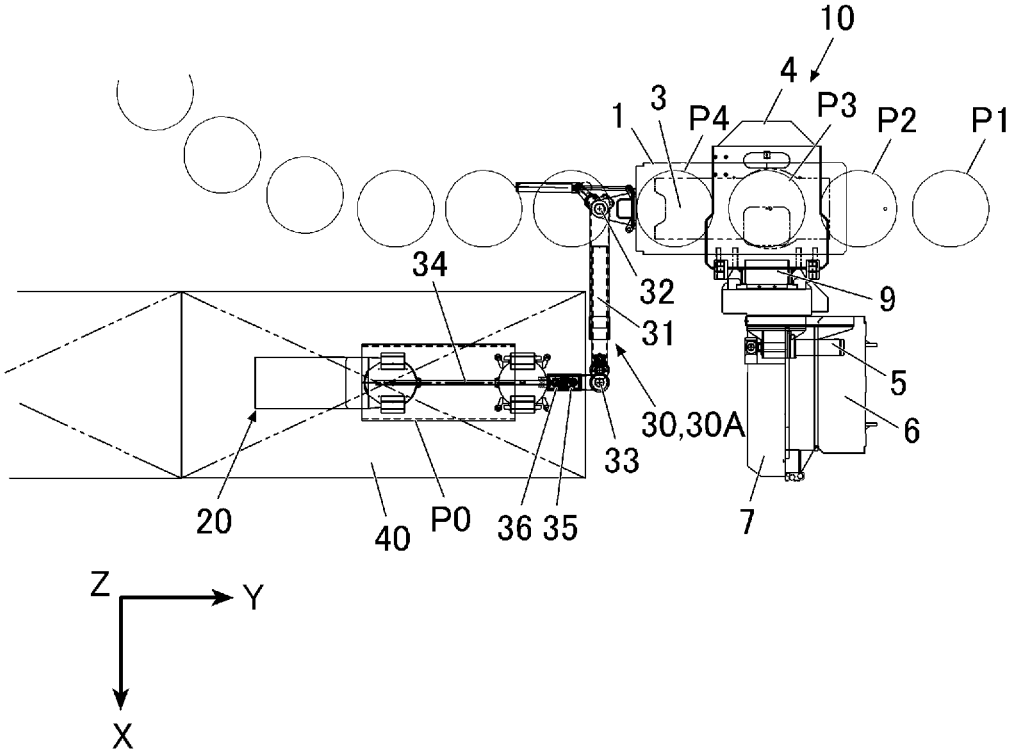
FIG. 7A This is a plan view that illustrates a situation for performing the pile press-in construction method over a water surface having height limitations.
Figure 7B:
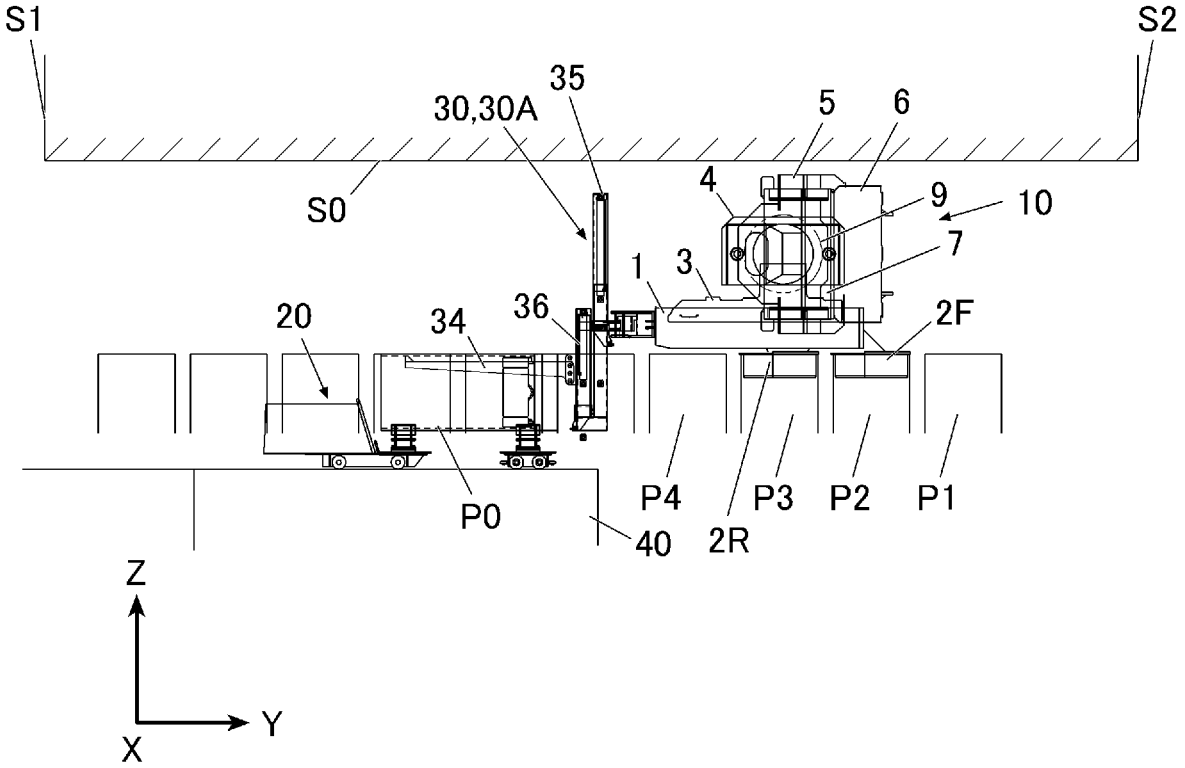
FIG. 7B This is a side surface view of FIG. 7A.

FIG. 1 through FIG. 7B illustrate a situation for performing a pile press-in construction method using a pile press-in device according to one embodiment of the present invention. FIG. 1 through FIG. 4 illustrate, by four scenes, an operation by a pile press-in device in a pile supplying step. FIG. 5A, FIG. 5B, FIG. 6A, and FIG. 6B illustrate two scenes in a situation for performing the method at a site having height limitations. FIG. 7A and FIG. 7B illustrate a situation for performing the method above a water surface having height limitations. Three orthogonal axes XYZ are illustrated in the drawings by taking a left-right direction axis as an X axis, a forward-rearward directional axis as a Y axis, and an up-down directional axis as a Z axis, in order to clarify directions.

Note that, in the following description, an "existing pile" refers to a pile for which pressing-in has already finished and no further press-in operation will be performed, regardless of pile type. In addition, a "press-in pile" refers to a pile for which pressing-in is to be performed or which is partway through pressing-in, regardless of pile type.

In the case of divided piles that configure an articulated pile by means of longitudinal joining, a divided pile which is in a state of being pressed into the ground, is scheduled to be connected by longitudinal joining to a new divided pile, and to which a press-in operation is to be applied as well as a divided pile in a state of being grasped by a chuck device 6 belonging to a pile press-in device 10 both correspond to a "press-in pile".

Longitudinal joining refers to connecting ends of a plurality of piles, which are disposed in-line while being aligned in the longitudinal direction, with one another.

The pile press-in device 10 is provided with a saddle 1, a plurality of clamp devices 2F and 2R that grasp upper ends of existing piles P1-P4, . . . pressed in to the ground and are provided at the bottom of the saddle 1, a slide base 3 that is provided so as to be able to move horizontally on the saddle 1, a mast 4 that is erected on the slide base 3 and is able to turn around a mast pivot MZ, a raising and lowering device 5, and the chuck device 6 that is supported by the mast 4 via the raising and lowering device 5 and grasps a pile P.

The chuck device 6 is installed in a chuck frame 7, is rotatable around a grasping central axis CZ, and can perform a rotary press-in method in which the chuck device 6 rotates in a state of holding a pile to thereby cause the pile to rotate and press in the pile.

Furthermore, the pile press-in device 10 is provided with a chuck tilting mechanism 9, and can use the chuck tilting mechanism 9 to tilt the chuck device 6, the chuck frame 7, and the raising and lowering device 5 about a chuck tilting axis CY in a direction in which the mast 4 and the chuck device 6 are aligned and which intersects with the mast 4.

The chuck device 6 and the chuck frame 7 are supported by the mast 4 via the raising and lowering device 5. A structure that includes the chuck device 6 and the chuck frame 7 has a through section 8 for inserting a pile.

The plurality of clamp devices 2F and 2R includes the clamp device 2F which is on a forward side and the clamp device 2R which is on a rearward side. Note that three or more clamp devices may be provided.

The slide base 3 slidingly moves in the forward-rearward direction. The clamp device 2R on the rearward side can also slidingly move in the forward-rearward direction, and an interval with respect to the clamp device 2F on the forward side can be varied. By virtue of this function, it is possible to align with intervals between piles.

Description is given regarding the pile press-in construction method, from a state in which the clamp devices 2F and 2R have gripped the upper ends of existing piles that have been pressed in to the ground.

Figure 1:
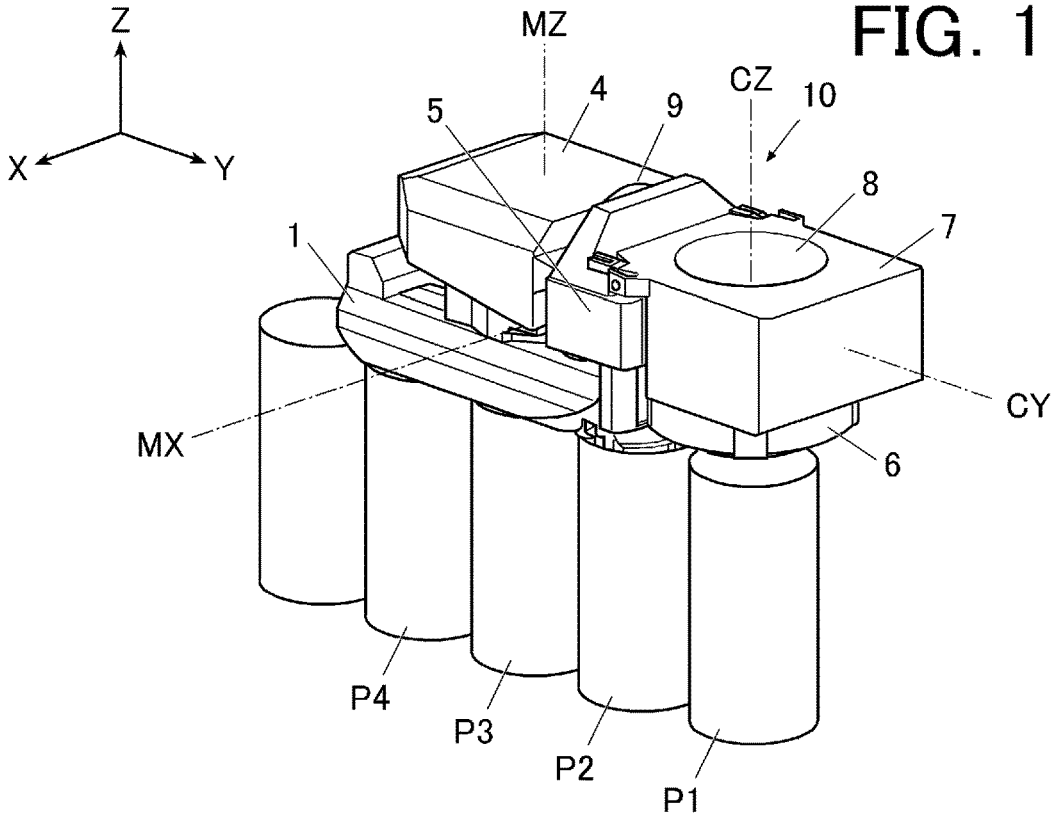
FIG. 1 This is a perspective view that illustrates a situation for performing a pile press-in construction method using a pile press-in device according to one embodiment of the present invention.

Currently, illustrated, the upper ends of the existing piles P2 and P3 are gripped by the clamp devices 2F and 2R. In FIG. 1, the pile P1 is already completely pressed in, but description is given from a situation in which the pile P1 is grasped by the chuck device 6 and is partway through being pressed in, while the upper ends of the existing piles P2 and P3 are gripped by the clamp devices 2F and 2R to generate reaction force, due to a stroke operation by the raising and lowering device 5 in a press-in orientation in which the axis of the through section 8 is the press-in direction (up-down direction) as illustrated in FIG. 1, the chuck device 6, the chuck frame 7, as well as the pile P1 grasped by the chuck device 6 are caused to descend (move in the press-in direction) to thereby press the pile P1 into the ground and achieve the press-in completion state in FIG. 1. As a result, the pile P1 will be the leading pile in a pile row in accordance with the existing piles.

A pile P0 is supplied next.

Figure 2:
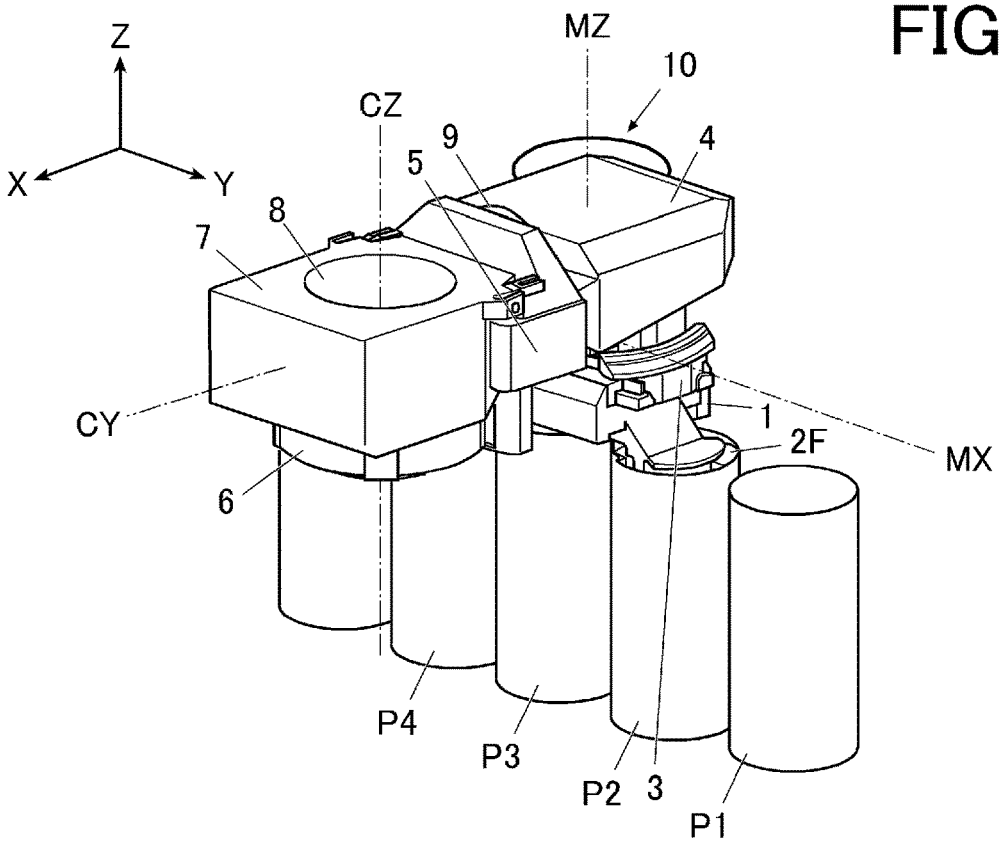
FIG. 2 This is a perspective view that illustrates a scene that has progressed from FIG. 1.

Accordingly, due to turning of the mast 4, an orientation in which the chuck device 6 protrudes to the side of the pile row P1, P2, P3, . . . as illustrated in FIG. 2 is achieved.

Figure 3:
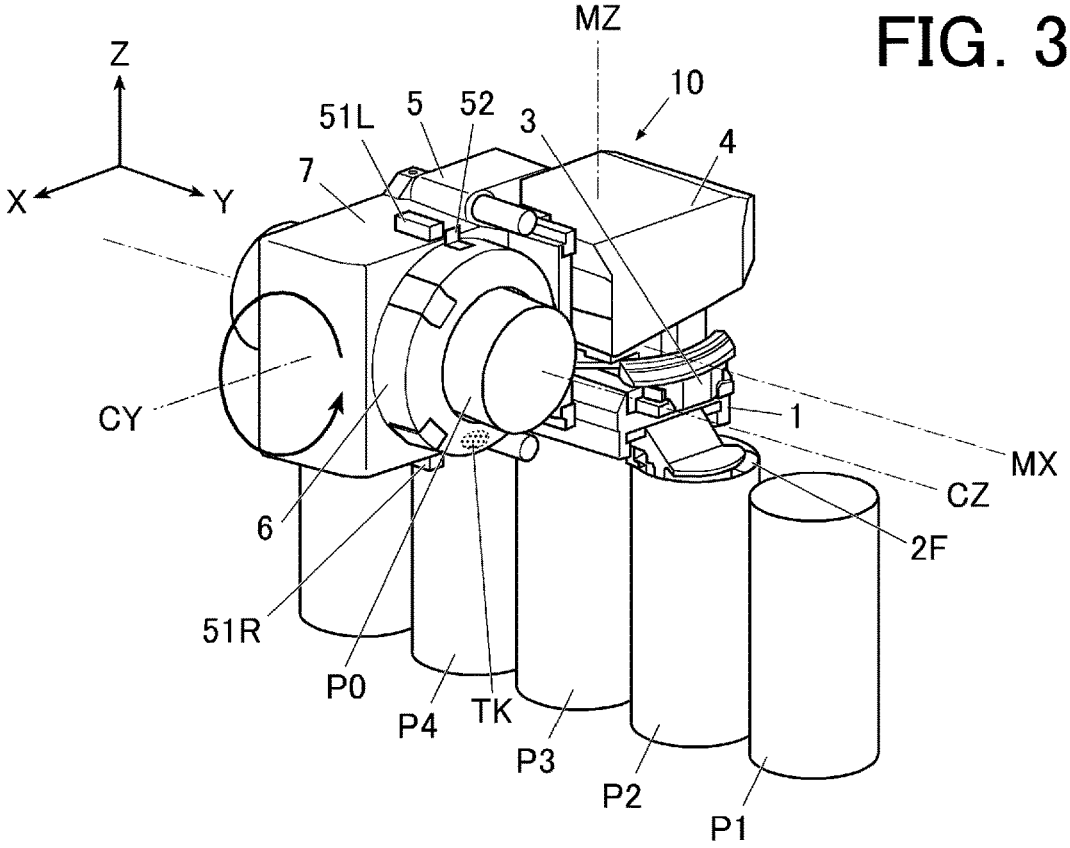
FIG. 3 This is a perspective view that illustrates a scene that has progressed from FIG. 2.

In addition, as illustrated in FIG. 3, FIG. 5A, and FIG. 5B, the chuck device 6 is made to be sideways due to tilting of the chuck device 6 by the chuck tilting mechanism 9. As a result, the axis of the through section 8 that inserts a pile becomes approximately horizontal, and thus the pile P0 is supplied in a laid-sideways state and is inserted into the through section 8 and grasped by the chuck device 6 while remaining in the laid-sideways state.

In other words, while the chuck device 6 is in a state of protruding sideways to the side of the pile row P1, P2, P3, . . . when the existing piles are seen from their axial direction as illustrated in FIG. 5A, the pile P0 is supplied while laid sideways, is inserted into the chuck device 6, and is grasped by the chuck device 6 (a pile supplying step) as illustrated in FIG. 6A and FIG. 6B. Note that, in FIG. 5A, FIG. 5B, FIG. 6A, and FIG. 6B, a pile transporting device 20 that can travel on a pile row, and a pile supplying device 30 that can pick up a pile from the pile transporting device 20 and supply the pile to the chuck device 6 in the pile press-in device 10 are used.

A crane may be used to supply the pile P0. When it is possible to move the pile P0 on the supply side in a horizontal direction following the pile row P1, P2, P3, . . . , this movement operation may be used to cause the pile P0 to move in the axial direction for the through section 8 and thereby be inserted into the chuck device 6.

In addition, it is possible to use an operation by the pile press-in device 10 to insert the pile P0 into the chuck device 6. This operation is a stroke operation by the slide base 3 and a stroke operation by the raising and lowering device 5. In a state illustrated in FIG. 3, a stroke direction by the slide base 3 and a stroke direction by the raising and lowering device 5 correspond to a direction of inserting the pile P0 into the chuck device 6. Accordingly, the pile P0 may be inserted into the chuck device 6 using a stroke operation by the slide base 3. In addition, the pile P0 may be inserted into the chuck device 6 using a stroke operation by the raising and lowering device 5.

As above, from among movement by the pile P0, a stroke operation by the slide base 3, and a stroke operation by the raising and lowering device 5, one or more of these may be performed to insert the pile P0 into the chuck device 6.

In the pile supplying step, it is possible to increase the insertion length of the pile P0 with respect to the chuck device 6 by at least a stroke by the slide base 3.

Similarly, in the pile supplying step, it is possible to increase the insertion length of the pile P0 with respect to the chuck device 6 by at least a stroke by the raising and lowering device 5.

Figure 4:
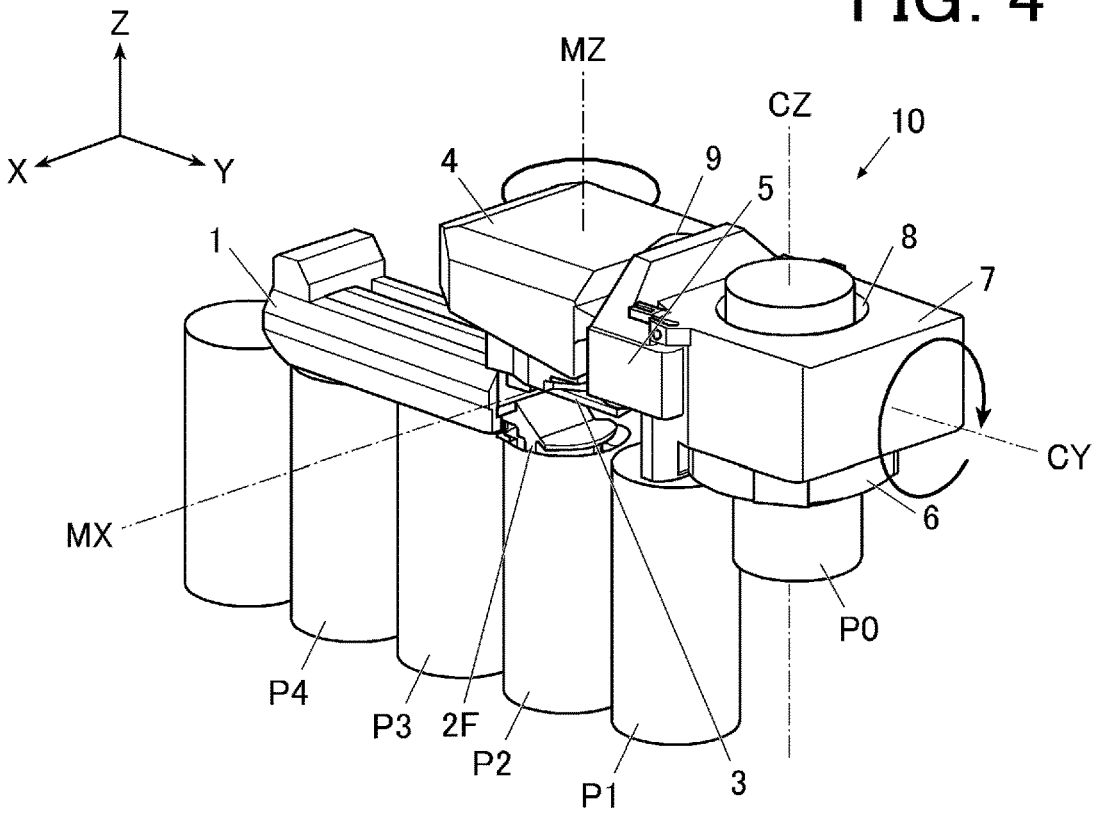
FIG. 4 This is a perspective view that illustrates a scene that has progressed from FIG. 3.

Thus, once the pile P0 is grasped by the chuck device 6, as illustrated in FIG. 4, the pile press-in device 10 uses turning of the mast 4 and tilting of the chuck device 6 to thereby transition to an orientation for pressing the pile P0 into the ground.

Similarly to pressing-in of the pile P1, the pile press-in device 10 grips the upper ends of the existing piles P2 and P3 by the clamp devices 2F and 2R to generate a reaction force, and now uses an operation by the raising and lowering device 5 to press the pile P0 into the ground.

Once the pile P0 is pressed in partway and achieves bearing capacity greater than or equal to that enabling the weight of the pile press-in device 10 to be supported, the pile press-in device 10 performs a forward-movement operation. The forward-movement operation is as follows.

Clamping by the clamp devices 2F and 2R is released, and the saddle 1 is raised by an operation by the raising and lowering device 5 while the pile P0, which is supported by the ground, continues to be grasped by the chuck device 6. Furthermore, a stroke operation by the slide base 3 is used to cause the saddle 1 to move forward, whereby the clamp device 2F is disposed above the existing pile P1 and the clamp device 2R is disposed above the existing pile P2, an operation by the raising and lowering device 5 lowers the saddle 1, the existing pile P1 is clamped by the clamp device 2F, and the existing pile P2 is clamped by the clamp device 2R. As a result, the pile press-in device 10 moves forward by one pitch, and the existing piles for generating reaction force at a time of press-in change to the piles P1 and P2.

Note that, when the pile at each press-in position is an articulated pile (press-in pile) resulting from using longitudinal joining to connect a plurality of divided piles in the longitudinal direction, there is a process for using longitudinal joining to continually connect, in the longitudinal direction, and to press in the plurality of divided piles (press-in piles) at the same press-in position. The forward-movement operation by the pile press-in device 10 is performed in a state in which the divided pile at the top end is grasped by the chuck device 6.

Once the existing piles P1 and P2 are clamped by the clamp devices 2F and 2R, the pile press-in device 10 resumes pressing in the pile P0, and completes pressing in the pile P0. This corresponds to completely pressing in the pile P1 described above (one cycle earlier), and means that the press-in work has advanced by one cycle. Taking this as one press-in cycle, press-in cycles are repeatedly executed. As a result, the pile press-in device 10 executes a pile press-in construction method for successively pressing in piles while moving on a pile row of the existing piles to thereby extend the pile row in the ground.

In a pile supplying step as illustrated in FIG. 6B, a central axis of the pile P0 inserted into the chuck device 6 laid sideways is in a position that is lower than the apex of the mast 4. Accordingly, supply and reception of a pile is possible in a space lower than that which the pile press-in device 10 can enter, and it is possible to increase the utility of pile press-in devices in areas with lower height limitations.

Next, description is given regarding details of a configuration and operation by the pile supplying device 30.

The pile supplying device 30 is provided with a pickup arm 30A that picks up and moves a pile while keeping the pile in a laid-sideways state.

In the present embodiment, the pickup arm 30A is provided with a swing arm 31. Hinged connectors 32 and 33 that can rotate around a vertical axis are provided at both ends of the swing arm 31. A base end of the swing arm 31 is secured to the saddle 1 via the hinged connector 32. Using the hinged connector 32, the swing arm 31 swings within a horizontal plane. The swing arm 31 has an extension/contraction function.

A fork 34 that can pick up and raise and lower a pile is provided at the tip of the swing arm 31. The hinged connector 33, a first raising and lowering device 35, a second raising and lowering device 36, and the fork 34 are connected in this order from the swing arm 31 side. Using the hinged connector 33, the fork 34 can swing within a horizontal plane. The first raising and lowering device 35 and the second raising and lowering device 36 are connected in series and thus it is possible to raise and lower the fork 34 by an amount resulting from adding a raising/lowering stroke by the second raising and lowering device 36 to a raising/lowering stroke by the first raising and lowering device 35.

Description is given regarding a pile supplying step in which the pile supplying device 30 is employed.

As illustrated in FIG. 5A and FIG. 5B, a state is entered in which the pickup arm 30A is extended rearward following the pile row and the fork 34 is at a height that enables the fork 34 to be inserted into the pile P0, and arrival of the pile transporting device 20 is awaited.

Due to forward movement by the pile transporting device 20, the fork 34 is inserted into the pile P0 which has been loaded onto the pile transporting device 20 (state in FIG. 5A and FIG. 5B).

Next, the fork 34 is raised and the pile P0 is picked up.

Once the pile P0 is picked up by the fork 34, the hinged connector 32 and the hinged connector 33 are each caused to move by approximately 90 degrees, and the pile P0 is disposed to the side of the pile row, as illustrated in FIG. 6A and FIG. 6B. At this point, the axial direction of the pile P0 is a direction that follows the pile row, and the end of the pile P0 on the opposite side to the end into which the fork 34 was inserted is presented forward (on the chuck device 6 side). The height of the central axis of the pile P0 is aligned with the height of the axis of the through section 8 which has been laid sideways.

As described above, the pile P0 is inserted into the chuck device 6, and the chuck device 6 is used to grasp the pile P0 and press the pile P0 into the ground.

Each movable part in the pile press-in device 10 and the pile supplying device 30 is provided with an actuator and, using a control device that performs integrated control of these actuators, operation for an above-described press-in cycle and a pile supply operation by the pile supplying device 30 are automatically controlled in the pile press-in device 10. A sensor that detects an operation amount by each movable part in the pile supplying device 30 in addition to the pile press-in device 10 is provided. An operation amount for each movable part is input to the control device, whereby accurate control (such as automatic press-in control, automatic pile supply control, or anti-interference control) is realized.

Of course, the control device also controls rotation of the chuck device 6 around the grasping central axis CZ and tilting of the chuck device 6 about the chuck tilting axis CY.

The control device has a limitation control function that uses control of rotation by the chuck device 6 around the grasping central axis CZ to set a portion of the chuck device 6 that drops or a portion that rises, due to the chuck device 6 tilting about the chuck tilting axis CY and as in FIG. 3, to a specific portion.

The chuck device 6 incorporates a hydraulic oil tank TK (FIG. 3 illustrates the position thereof) that drives a grasping claw. For example, with an orientation angle of the hydraulic oil tank TK when the hydraulic oil tank TK is raised to a high position, there are cases where a defect occurs in inflow and outflow of hydraulic oil in the hydraulic oil tank TK by an inlet and an outlet provided in the hydraulic oil tank TK rising higher than a liquid surface within the hydraulic oil tank TK. In such a case, the control device controls rotation around the grasping central axis CZ to set the portion of the chuck device 6, which drops as in FIG. 3 due to tilting about the chuck tilting axis CY, to a portion at which the hydraulic oil tank TK is present.

The pile press-in device 10 is provided with a sensor for realizing such control. For example, one or more of this sensor are provided on the chuck frame 7 (for example, sensors 51L and 51R in FIG. 3). In this case, a detection-target member that is detected by such a sensor is provided in the chuck device 6 (for example, a detection-target member 52 in FIG. 3). As a result, it is possible to detect a specific rotation phase of the chuck device 6. In the example described above, it is possible to detect whether or not at least the hydraulic oil tank TK is in a lowest phase due to tilting about the chuck tilting axis CY. In FIG. 3, the detection-target member 52 is illustrated on a side that is 180 degrees opposite to the hydraulic oil tank TK for the convenience of clarifying the drawing, but the detection-target member 52 may be this position or may be the position of the hydraulic oil tank TK. The position of the detection-target member 52 illustrated in FIG. 3 is described below.

Depending on the direction of the tilting of the chuck device 6 about the chuck tilting axis CY, there are two portions (phases) that drop: a left-side surface portion and a right-side surface portion of the chuck frame 7. In FIG. 3, the right-side surface portion of the chuck frame 7 becomes the portion (phase) that drops. Therefore, control is performed to execute tilting about the chuck tilting axis CY in a state where the detection-target member 52 has been detected by the sensor 51L. In a case of causing tilting by reverse rotation to this, the left-side surface portion of the chuck frame 7 becomes the portion (phase) that drops. Therefore, control is performed to execute tilting about the chuck tilting axis CY in a state where the detection-target member 52 has been detected by the sensor 51R. In this manner, the pile press-in device 10 performs the above-described limitation control function which corresponds to tilting in both directions about the chuck tilting axis CY.

Note that, although "portion . . . that drops or portion that rises" was expressed, it is merely an expression for convenience, and these do not need to be substantially distinguished. This is because dropping a portion that is desired to be dropped is the same as raising a portion that is 180 degrees opposite to the portion that is desired to be dropped, and raising a portion that is desired to be raised is the same as dropping a portion that is 180 degrees opposite to the portion that is desired to be raised. Without limitation to a case where there is a portion that is desired to be dropped in conjunction with tilting of the chuck device 6 about the chuck tilting axis CY, there can be effective application to a case where there is a portion that is desired to be raised (a case where there is a portion that is not desired to be dropped, and a case where there is a portion that is not desired to be raised). In addition, when there is a portion that is not desired to be raised or dropped in conjunction with tilting of the chuck device 6 about the chuck tilting axis CY, it may be that a portion that is +90 degrees with respect to this portion is set as the specific portion, which is the portion that drops or portion that rises.

Description is given regarding a case in FIG. 7A and FIG. 7B.

In a situation illustrated in FIG. 7A and FIG. 7B, the pile transporting device 20 travels on a barge 40.

The pile transporting device 20 travels on the barge 40 to thereby approach the pile supplying device 30. At this point, the pile P0 loaded on the pile transporting device 20 is separated sideways from the pile row, differing from the case in FIG. 5A and FIG. 5B. Accordingly, with reference to the state illustrated in FIG. 5A and FIG. 5B in which the pickup arm 30A is extended rearward, a crank-shape state is entered in which the hinged connector 32 is moved approximately 90 degrees to the barge 40 side and the hinged connector 33 is moved approximately 90 degrees to the opposite side thereof, as illustrated in FIG. 7A and FIG. 7B. In addition, the pile P0 loaded on the pile transporting device 20 is positioned downward from the upper ends of the pile row, differing from the case in FIG. 5A and FIG. 5B. Accordingly, as illustrated in FIG. 7A and FIG. 7B, the fork 34 is disposed lower in comparison to the case in FIG. 5A and FIG. 5B. In any case, the fork 34 is controlled to a height that enables insertion into the pile P0.

Due to forward movement by the pile transporting device 20, the fork 34 is inserted into the pile P0 which has been loaded onto the pile transporting device 20 (state in FIG. 7A and FIG. 7B). Afterwards is similar to the cases in FIG. 5A, FIG. 5B, FIG. 6A, and FIG. 6B.

Note that, when it is possible to use a crane to supply the pile P0 to the pile press-in device 10 due to the pile press-in device 10 being present at a position close to a terminal end S1 or S2 of a height limitation S0, a crane may be used to supply the pile P0 to the pile press-in device 10. In this case, the pile P0 is suspended by the crane in a laid-sideways state.

FIG. 5A, FIG. 5B, FIG. 7A, and FIG. 7B illustrate scenes of inserting the pile P0 into the chuck device 6 from rearward in the direction in which the pile row extends, in a pile supplying step.

However, in the pile supplying step, the pile P0 may be inserted into the chuck device 6 from forward in the direction in which the pile row extends.

The pile P0 suspended by the crane may be inserted into the chuck device 6 from behind when the pile press-in device 10 is close to the terminal end S1 of the height limitation S0. The pile P0 suspended by the crane may be inserted into the chuck device 6 from in front when the pile press-in device 10 is close to the terminal end S2 of the height limitation S0.

In addition, when the barge 40 illustrated in FIG. 7A and FIG. 7B is disposed in front of the pile press-in device 10, the pile P0 may be inserted into the chuck device 6 from in front in the direction in which the pile row extends.

It is possible to automate the above operations by the pile press-in device 10, the pile transporting device 20, and the pile supplying device 30 to thereby safely and efficiently carry out a construction method for extending a pile row under a height limitation.

Next, description is given regarding a method of handling various types of piles.

Steel pipe piles are illustrated as piles in FIG. 1 through FIG. 7B, but the present invention can be applied to various types of piles.

Figure 8A:
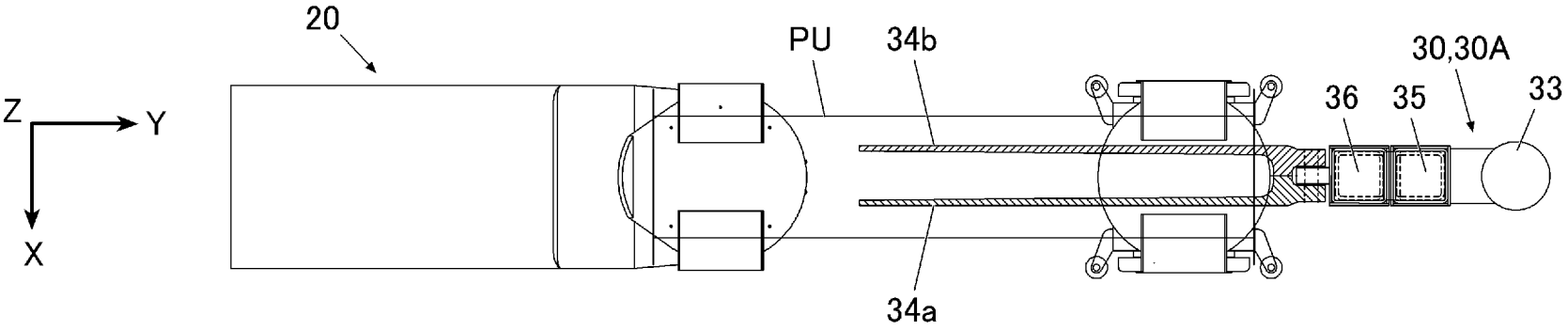
FIG. 8A This is a plan view that illustrates a situation of transporting a U-shaped steel sheet pile and picking up the U-shaped steel sheet pile using a fork.
Figure 8B:
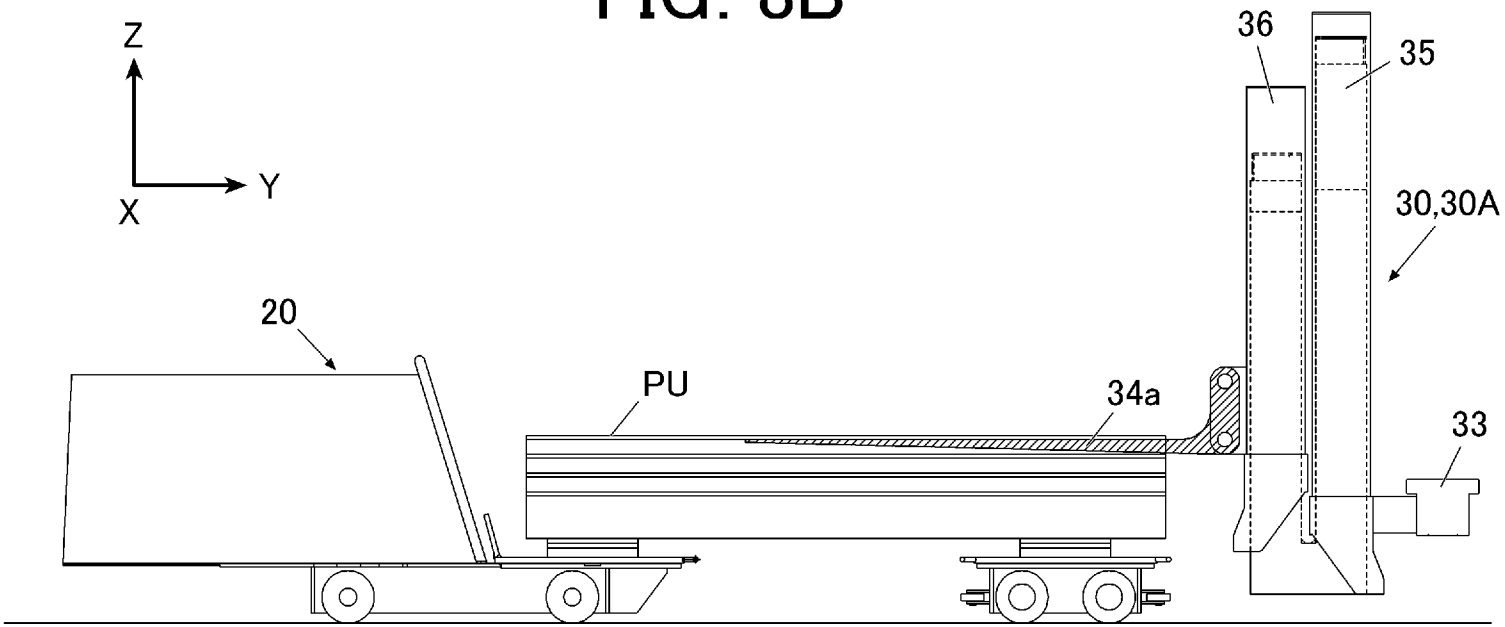
FIG. 8B This is a side surface view of FIG. 8A.
Figure 8C:
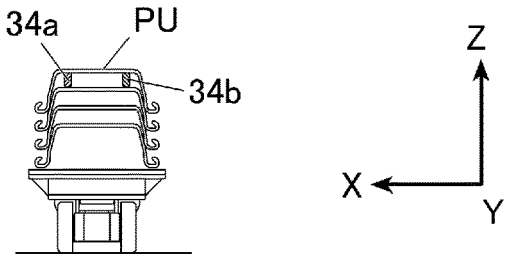
FIG. 8C This is a cross-sectional view of FIG. 8A.

FIG. 8A through FIG. 8C illustrate a case for a U-shaped steel sheet pile PU.

In order to handle the U-shaped steel sheet pile PU, the fork has two prongs 34*a* and 34*b*—and the two prongs 34*a* and 34*b* are inserted into a central section of the U-shaped steel sheet pile PU, and balance is achieved. In other words, it is possible to be able to pick up the U-shaped steel sheet pile PU by the two prongs 34*a* and 34*b* while the U-shaped steel sheet pile PU is kept in the direction of the loaded state illustrated in FIG. 8A through FIG. 8C.

In addition, it is possible to load a plurality of the U-shaped steel sheet pile PU onto the pile transporting device 20 to thereby increase work efficiency. On this point, the two prongs 34*a* and 34*b* are made to have a shape that can be inserted into a gap in a plurality of U-shaped steel sheet piles PU that have been stackingly loaded vertically. Therefore, it is possible to use the two prongs 34*a* and 34*b* to smoothly pick up one pile at a time.

Figure 9:
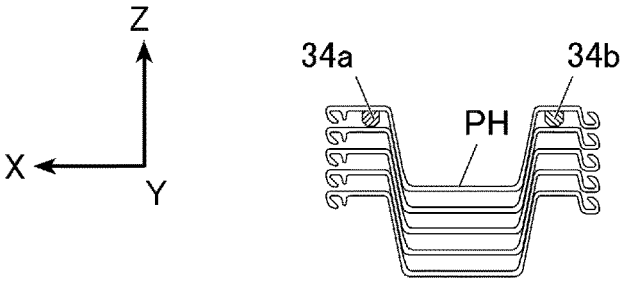
FIG. 9 This is a cross-sectional view that illustrates a situation for a pick up using a fork with respect to a hat-shaped steel sheet pile.

In addition, it is also possible to similarly handle hat-shaped steel sheet piles PH illustrated in FIG. 9. With respect to a hat-shaped steel sheet pile PH, positions for inserting the two prongs 34*a* and 34*b* are under arm sections on both sides. Other points can be similar to the case for the U-shaped steel sheet pile PU.

Figure 10:
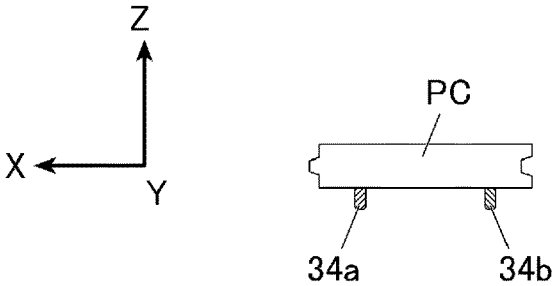
FIG. 10 This is a cross-sectional view that illustrates a situation for a pick up using a fork with respect to a concrete sheet pile.

In addition, using the two prongs 34*a* and 34*b*, it is possible to stably pick up even a flat plate-shaped concrete sheet pile PC that is illustrated in FIG. 10.

Figure 11:
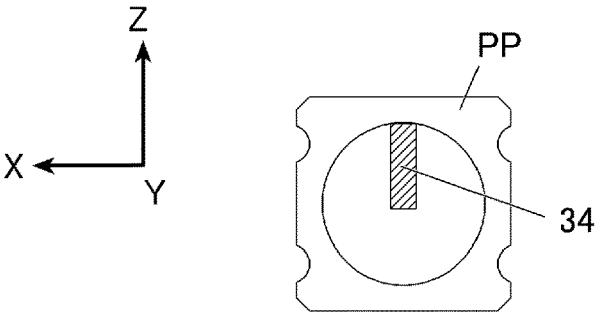
FIG. 11 This is a cross-sectional view that illustrates a situation for a pick up using a fork with respect to a PC wall body.

In addition, it is possible to pick up a tubular PC wall body PP illustrated in FIG. 11 by inserting one fork 34 similarly to the case for the steel pipe piles illustrated in FIG. 1 through FIG. 7B.

In particular, the U-shaped steel sheet piles PU and hat-shaped steel sheet piles PH have structures in that, when these are stacked under a condition of being in direct contact without another member therebetween, vertical regular gaps are present therebetween. By employing a two-prong shape that can be inserted into such a gap, work for loading U-shaped steel sheet piles PU and hat-shaped steel sheet piles PH as well as work for picking up U-shaped steel sheet piles PU and hat-shaped steel sheet piles PH is streamlined.

By virtue of the above embodiment, there is a pile supplying step for laying the pile P0 sideways, supplying the pile P0, inserting the pile P0 into the chuck device 6, and causing the chuck device 6 to grasp the pile P0 while, in accordance with turning of the mast 4 and tilting of the chuck device 6, maintaining a state in which the chuck device 6 is laid sideways and protruding on the side of the pile row P1, P2, P3, . . . when the existing pile is seen from the axial direction. Therefore, it is possible to supply a pile within the range of the height in which the pile press-in device 10 is present at a time of a pile press-in orientation as illustrated in FIG. 1 and FIG. 4.

As described above, the pile press-in device 10 has a functional for self-propelled movement on a pile row while extending the pile row by repeatedly pressing in piles. It is unquestionably possible to supply a pile to the chuck device 6 using the above-described pile supplying step in a low-height area in which the pile press-in device 10 can enter while carrying out pile press-in construction. Therefore, it is possible to continue pile press-in construction without a pause due to pile supplying not being possible, and it is possible to extend a pile row within the low-height area.

Accordingly, it is possible to increase the utility of a pile press-in device in areas with lower height limitations.

The present invention is also useful, even in an area having no height limitations or in an area that has few height limitations but has restricted space surrounding piles.

In other words, the present invention does not need a work machine such as a crane that holds a pile, which would require an installation area near the pile, and thus the present invention exhibits an effect even in pile press-in construction on water, on sand, or the like.

Note that, in the above-described pile press-in device 10, reaction force at a time of pile press-in is transmitted from the chuck device 6 to the mast 4 and the clamp devices 2F and 2R, via the chuck frame 7, the raising and lowering device 5, and the chuck tilting mechanism 9. At this time, force is applied sideway with respect to the rotation axis of the chuck tilting mechanism 9, and thus there is a risk of damage in accordance with the structure thereof. In such a case, a connection securing mechanism that secures the connecting between the mast 4 and a frame part of the raising and lowering device 5 may be configured using, for example, a movable lock pin mechanism. At the time of a press-in operation, the connection securing mechanism is set to a connection secured state, whereby it is possible to prevent damage to the chuck tilting mechanism 9. When causing the chuck tilting mechanism 9 to operate, the connection secured using the connection securing mechanism is set to a released state.

It is desirable for parts (the raising and lowering device 5, the chuck device 6, and the chuck frame 7) that rotate at time of tilting by the chuck tilting mechanism 9 to rotate within as narrow a space as possible. For example, by keeping within an approximate range in which the full width of the pile press-in device 10 is set as a diameter. This is in order not to interfere with the height limitation S0.

It is desirable to concurrently execute the final stage of the pile press-in step by the pile press-in device 10, and the initial stage of the pile supplying step by the pile supplying device 30. For example, the next pile is picked up by the pickup arm 30A before pressing in is completed. As a result, it is possible to streamline work and shorten a construction time period.

In addition, the pile press-in device 10 can tilt the mast 4 about a mast tilting axis MX in order to cause the chuck device 6 to move up and down. By causing the mast 4 to tilt about the mast tilting axis MX, the chuck device 6 enters a state in which the front end thereof on the side opposite to the mast 4 has dropped, as illustrated in FIG. 12.

Figure 12:
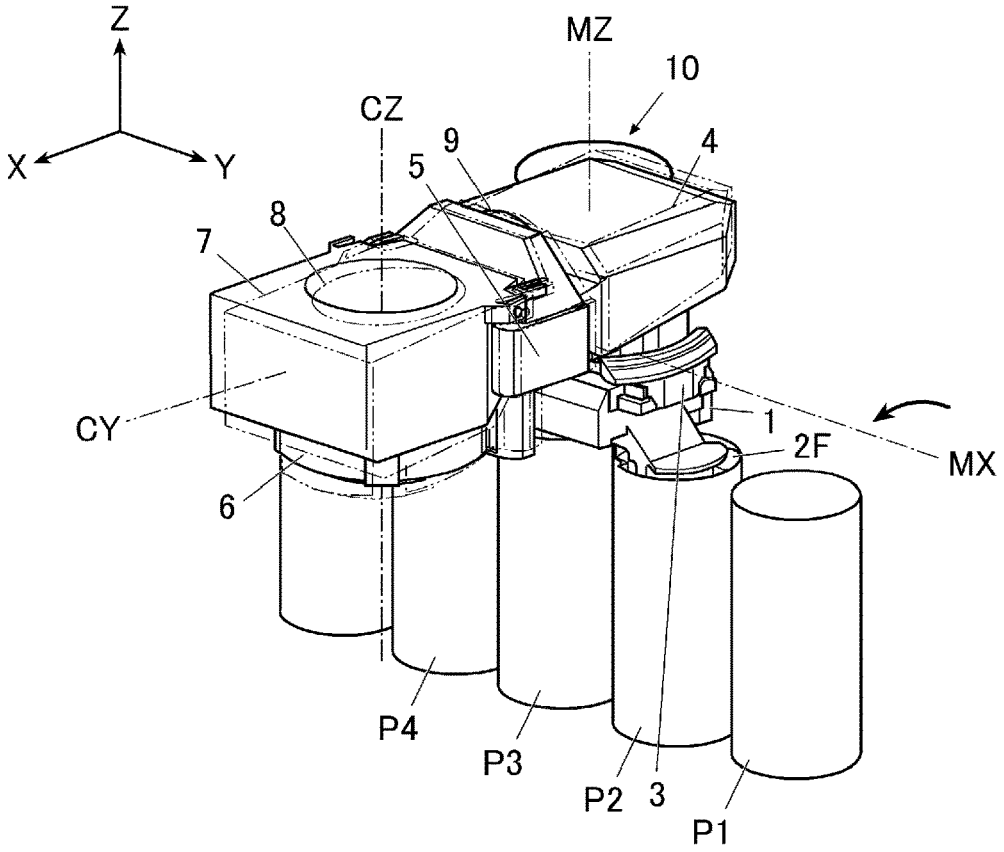
FIG. 12 This is a perspective view that illustrates a situation for performing a pile press-in construction method using a pile press-in device according to one embodiment of the present invention, and illustrates a situation in which the mast is caused to tilt with respect to that in FIG. 2.

As a result, it is possible to hold the chuck device 6 in a low position as illustrated in FIG. 12. In addition, when the chuck device 6 is grasping a pile, it is possible to hold the chuck device 6 and the pile grasped thereby in a low position. Note that the grasping central axis CZ and the chuck tilting axis CY also tilt in accordance with tilting of the mast 4 about the mast tilting axis MX (no impact on the mast pivot MZ).

The mast 4 is caused to tilt about the mast tilting axis MX whereby a state is entered in which the front end of the chuck device 6 on the side opposite to the mast 4 drops and the chuck device 6 or the chuck device 6 with a pile held thereby are held in a low position, in, from the pile supplying step described above, some or all of a process for entering a state in which the chuck device 6 is laid sideways and protruding on the side (FIG. 1→FIG. 2→FIG. 3), a process for inserting a pile into the chuck device 6 (FIG. 3), as well as a step for erecting a pile by tilting the chuck device 6 about the chuck tilting axis CY from a state where the pile is grasped by the chuck device 6 in accordance with the pile supplying step (FIG. 3→FIG. 4).

As a result, it is possible to prevent a portion of the pile press-in device 10 (such as a side part of the raising and lowering device 5) that becomes the highest in the orientation in FIG. 3 or the upper end of the pile grasped by the chuck device 6 from interfering with the height limitation S0.

As above, a function of tilting the mast 4 about the mast tilting axis MX is also used to execute a transition from the press-in orientation (FIG. 1) to a pile supply orientation (FIG. 3) and a transition from the pile supply orientation (FIG. 3) to the press-in orientation (FIG. 4), whereby it is possible to increase the utility of pile press-in devices in areas with lower height limitations.

In addition, the function of tilting the mast 4 about the mast tilting axis MX can also be used to adjust the position of the grasping central axis CZ in some or all of the process for inserting a pile into the chuck device 6 (FIG. 3). As a result, it is possible to suppress, for example, contact between the chuck device 6 and the pile, and perform a good operation for inserting the pile into the chuck device 6.

In addition, in a case of using the pickup arm 30A to supply the pile, it is possible to use, for example, a function of raising and lowering the fork 34 and a function of extending and contracting the swing arm 31 to adjust an axis position of the pile which is to be inserted into the chuck device 6. Accordingly, it becomes possible to perform adjustment in a wider range, in combination with an operation for adjusting the position of the grasping central axis CZ.

[Performing Pile Press-In Construction Method (2)]

Description is given below regarding a pile press-in construction method for pressing in a pile (an articulated pile) that includes divided piles (press-in piles), using a holding chuck attachment 60, in the pile press-in device 10 already described.

Figure 13:
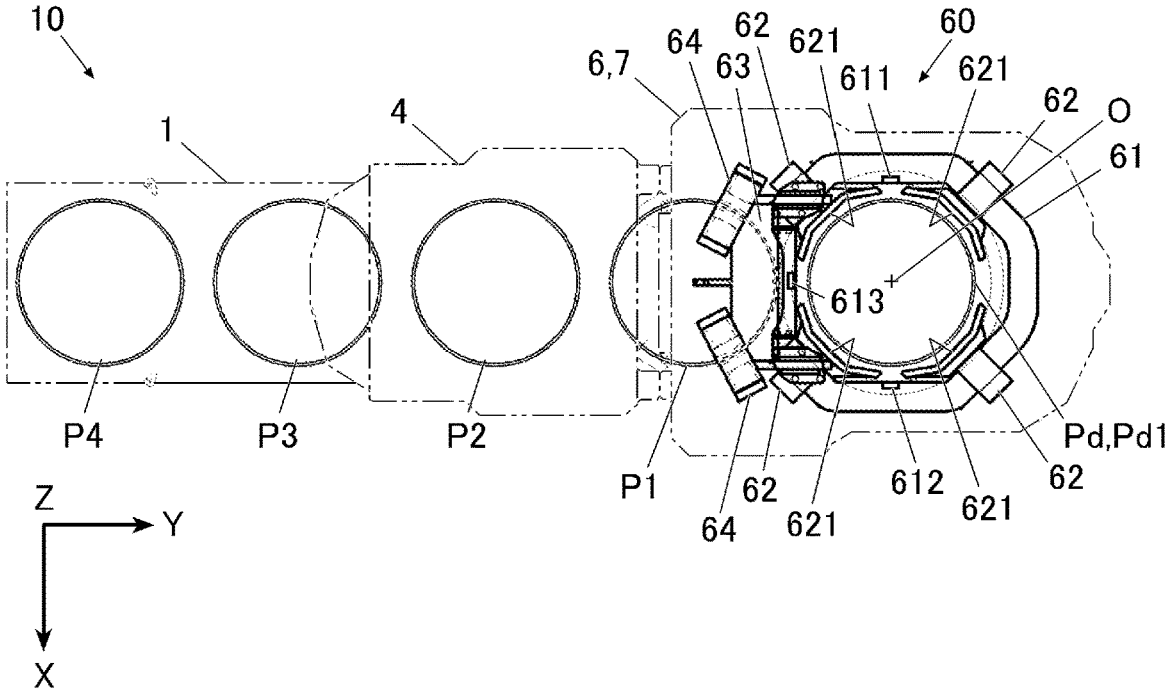
FIG. 13 This is a plan view of a holding chuck attachment which is illustrated by also including a disposition for at a time of pile press-in construction.
Figure 14:
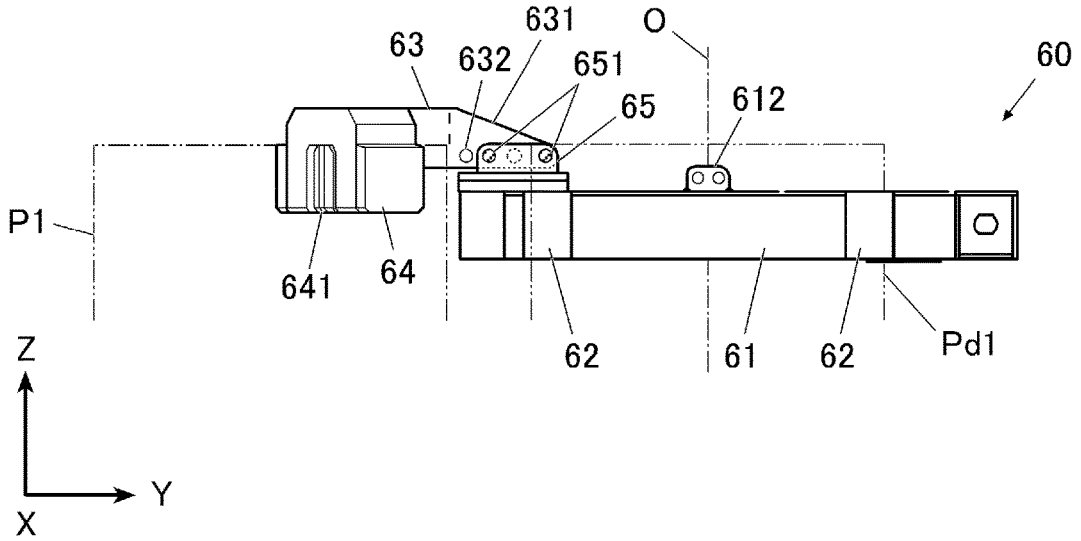
FIG. 14 This is a side surface view of the holding chuck attachment.

FIG. 13 is a plan view of the holding chuck attachment 60, illustrated by including a disposition with respect to the pile press-in device 10 and the pile row P1, P2, P3, . . . at a time of pile press-in construction, and FIG. 14 is a side surface view thereof.

In the present embodiment, a case where a divided pile Pd is a steel pipe pile is exemplified. However, a subject to be pressed in is not limited to a steel pipe pile.

The holding chuck attachment 60 is used when burying a plurality of divided piles (press-in piles) Pd1, Pd2, . . . (refer to FIG. 15 through FIG. 17) in order while using longitudinal joining to connect the plurality of divided piles in the longitudinal direction. Note that, in the following description, the divided piles Pd1, Pd2, . . . are generically referred to as a "divided pile Pd" when there is no particular need to distinguish them.

The divided piles Pd are steel pipe piles that all have the same outer diameter and inner diameter, and are short in the longitudinal direction. Pressing in work of these divided piles Pd (press-in piles) is performed by alternating repeating pressing in and longitudinal joining for joining a new divided pile Pd (press-in pile).

Divided piles Pd are suitable for a case of performing pile press-in work in an area having a limitation in the up-down direction and in which the height limitation S0 described above is present. The chuck device 6 uses a divided pile Pd having a length that is able to avoid interference between a pile head and the height limitation so in a press-in orientation.

In contrast, in a case of a divided pile that is initially pressed in (for example, the first divided pile Pd1, or the like), there is the risk of not being able to appropriately perform work for connecting the next divided pile Pd2 (press-in pile), when the lower end of the divided pile Pd1 (press-in pile) does not reach the ground in a stroke by the raising and lowering device 5 or when a press-in depth is insufficient and the divided pile Pd1 becomes unstable.

In such a case, the holding chuck attachment 60 is used in order to hold the divided pile Pd1 (press-in pile).

The holding chuck attachment 60 is secured to the pile head of the existing pile P1 and grasps the upper section of the divided pile Pd1 below the chuck device 6 to thereby make it possible to address stabilizing the divided pile Pd1 and connecting the next divided pile Pd2 (press-in pile).

Note that the holding chuck attachment 60 can be mounted to the chuck frame 7 in the pile press-in device 10, and can move together with the pile press-in device 10.

As illustrated in FIG. 13 and FIG. 14, the holding chuck attachment 60 has a frame body 61 into which the divided pile Pd can be inserted movably in the up-down direction, a plurality of grasping mechanisms 62 that hold the divided pile Pd within the frame body 61, a connecting frame 63 that is connected to a rear end of the frame body 61, and a plurality of securing clamp devices 64 that are provided on the connecting frame 63.

The frame body 61 and the plurality of grasping mechanisms 62 configure the holding chuck device.

The frame body 61 has an approximately octagonal shape in plan view that is widely opened vertically, and it is possible to movably insert a divided pile Pd therein. Note that the shape in plan view of the frame body 61 is not limited to an octagonal shape, and is any shape as long as it is possible to pass the divided pile Pd therethrough.

There may be a plurality of the grasping mechanism 62 and there is no limitation on the number thereof, but a case where four grasping mechanisms 62 are provided on the frame body 61 is exemplified in the present embodiment.

The four grasping mechanisms 62 are provided on the frame body 61 at uniform intervals following the circumference of a circle that is concentric with the center of the opening in the frame body 61. It is assumed below that the central axis of this concentric circle is a central axis O of the frame body 61.

Each grasping mechanism 62 has a recess-shaped grasping claw 621 that performs forward and backward movement with respect to the central axis O of the frame body 61, and a hydraulic cylinder (not illustrated) which corresponds to an actuator that applies a forward/backward movement operation to the grasping claw 621.

Each grasping claw 621 grasps by the inside of the recess thereof making pressure contact with the outer peripheral surface of the divided pile Pd. Accordingly, a pressure-contact surface on which machining for increasing a friction force such as unevenness or a spike structure is performed on the inside of the grasping claw 621.

The divided pile Pd, which is movably inserted following the up-down direction into the opening in the frame body 61, is held in a state where the recesses in the four grasping claws 621, which perform a forward movement toward the central axis O, fit with the outer peripheral surface of the divided pile Pd and the divided pile Pd is concentric with the central axis O of the frame body 61.

Each hydraulic cylinder is, for example, a double-acting hydraulic cylinder and is provided with a cylinder tube and a piston rod. The piston rod supports the grasping claw 621 by the tip thereof. The hydraulic cylinder is held by the frame body 61 such that the piston rod performs a forward/backward operation along the radial direction of a circumference centered on the central axis O.

Figure 16:
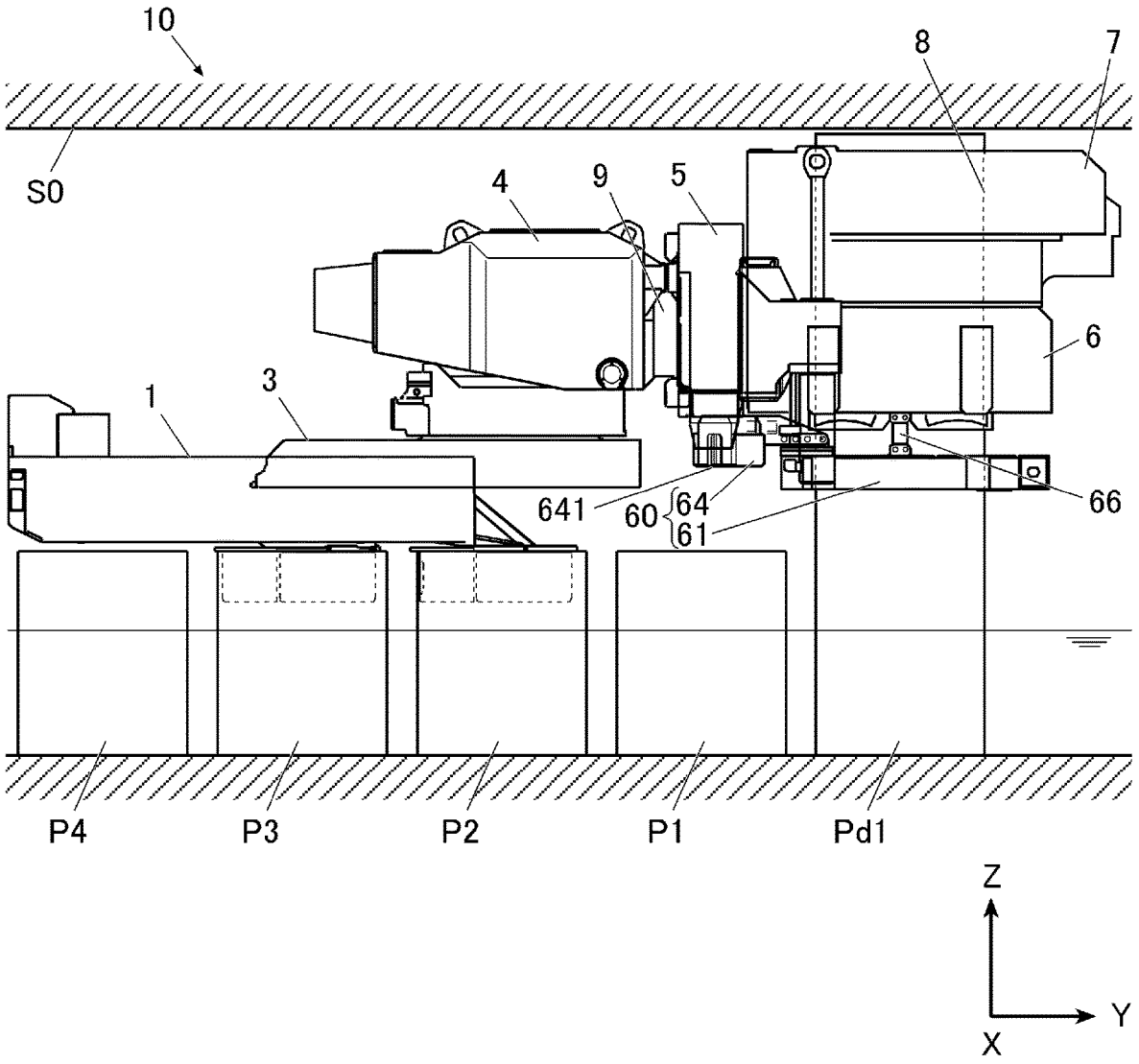
FIG. 16 This is a step view for the pile press-in construction method for divided piles, continuing from FIG. 15.

Near both of left and right ends as well as near the rear end on the top surface of the frame body 61, there are sections to be connected 611-613 that removably connect the holding chuck attachment 60 to the chuck frame 7 via a bracket 66 (refer to FIG. 16).

Each of the sections to be connected 611-613 has a plate-shaped section erected on the top surface of the frame body 61, and two or three through holes that horizontally penetrate the plate-shaped section are formed. In contrast to this, a lower end of the bracket 66 has two plate-shaped sections that can be inserted into the plate-shaped section of the sections to be connected 611-613, and two or three through holes that penetrate horizontally similarly to the sections to be connected 611-613 are formed in these plate-shaped sections. The sections to be connected 611-613 are inserted between the two plate-shaped sections belonging to the bracket 66 such that the through holes in the sections to be connected 611-613 overlap with the through holes in the bracket 66, and connecting pins are inserted into the overlapped through holes whereby it is possible to connect the through holes in the sections to be connected 611-613 with the bracket 66. The connecting pins can be pulled out, as a result of which it is possible to separate the through holes in the sections to be connected 611-613 from the bracket 66.

Note that sections to be connected having the same structure as the sections to be connected 611-613 are provided on the bottom of the chuck frame 7 at dispositions corresponding to the sections to be connected 611-613, and enable connecting to and separating from the upper end of the bracket 66.

In the holding chuck attachment 60, which is mounted to the bottom of the chuck frame 7 by the sections to be connected 611-613, the dispositions of the sections to be connected 611-613 are set such that the central axis O of the frame body is concentric with the grasping central axis CZ of the chuck device 6.

Accordingly, it is possible to use the chuck device 6 to grasp the divided pile Pd while the holding chuck attachment 60 is mounted to the bottom of the chuck frame 7.

The connecting frame 63 has a pair of plate-shaped connecting arms 631 that are extended forward from both of left and right ends of the front surface thereof. In contrast to this, a pair of connecting brackets 65 corresponding to the connecting arms 631 are securely installed on both of left and right ends of the rear-end top surface of the frame body 61.

Lined up in the forward-backward direction on the lower end of each connecting arm 631, a plurality of connecting holes 632 are formed penetrating in the left-right direction.

In contrast to this, each connecting bracket 65 on the frame body 61 side has two plate-shaped sections into which a connecting arm 631 can be inserted from above, and two connecting holes 651 are formed in these plate-shaped sections at the same positions seen from the side.

In a state where the two connecting holes 651 in the connecting bracket 65 are overlapped with the two connecting holes 632 in the connecting arm 631, connecting pins are inserted into the overlapped through holes to thereby enable the connection between the connecting arm 631 (connecting frame 63) and the connecting bracket 65 (frame body 61).

In addition, it is possible for more connecting holes 632 to be formed lined up in the forward-backward direction in each connecting arm 631 and slide the connecting arm 631 in the forward-backward direction with respect to a connecting bracket 65 to thereby overlap another connecting hole 632 with a connecting hole 651 in the connecting bracket 65, whereby the mutual interval in the forward-backward direction between the connecting frame 63 and the frame body 61 is changed and adjusted.

In other words, the connecting arms 631 and the connecting brackets 65 configure an adjustment mechanism that adjusts the interval between the securing clamp devices 64 and the holding chuck device.

As a result, even when there are different pitches for the pile row P1, P2, P3, . . . , it is possible to hold the divided pile Pd at an appropriate position.

In addition, because the connecting arms 631 are connected in a state of sitting on the frame body 61 via the connecting brackets 65, the holding chuck device (the frame body 61) has a lower position than the securing clamp devices 64, in a state where the holding chuck attachment 60 is secured to existing piles P. Accordingly, it is possible to hold the frame body 61 and the divided pile Pd1 at a lower position, and it is possible to use a pile having a longer length as the divided piles Pd for the divided pile Pd2 and thereafter.

The securing clamp devices 64 are provided on both of left and right sides on the rear end of the connecting frame 63.

A downward-facing slit 641 is formed in each securing clamp device 64, and it is possible to insert a tube wall upper end at the pile head of an existing pile P into the slit 641. Note that the two securing clamp devices 64 are each securely installed in a state of being tilted with respect to the rear end of the connecting frame 63 such that each slit 641 follows a tangential direction for the tube wall of an existing pile P.

Each securing clamp device 64 has two clamp units that are facingly disposed with the slit 641 therebetween.

Each of the two facing clamp units has a hydraulic cylinder, and each hydraulic cylinder has a movable cylinder and a piston rod. The piston rod is supported by carrying back pressure within the securing clamp device 64 and, in accordance with hydraulic pressure, the movable cylinder performs a forward/backward operation with respect to the piston rod.

The tip of the movable cylinder is equipped with a pressure-contact body having a pressure-contact surface on which machining for increasing a friction force such as unevenness or a spike structure is performed.

As a result, it is possible to use the pressure-contact bodies in the two clamp units to clamp the tube wall of an existing pile P that is inserted into the slit 641 from the bottom.

Accordingly, the two securing clamp devices 64 clamp the tube wall of the existing pile P across two locations, whereby the holding chuck attachment 60 can be stably secured to the existing pile P.

Figure 15:
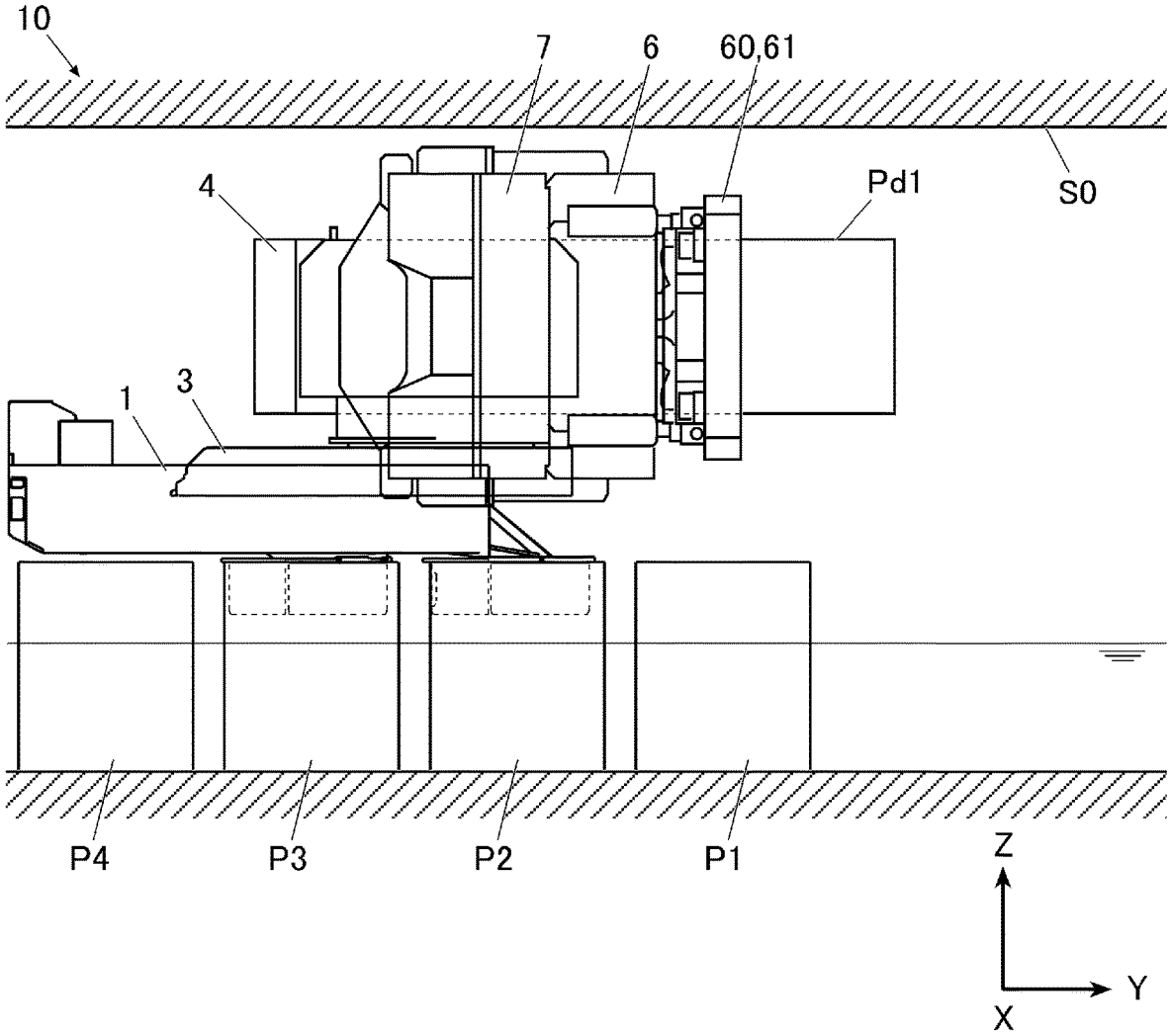
FIG. 15 This is a step view for a pile press-in construction method for divided piles using the holding chuck attachment.
Figure 17:
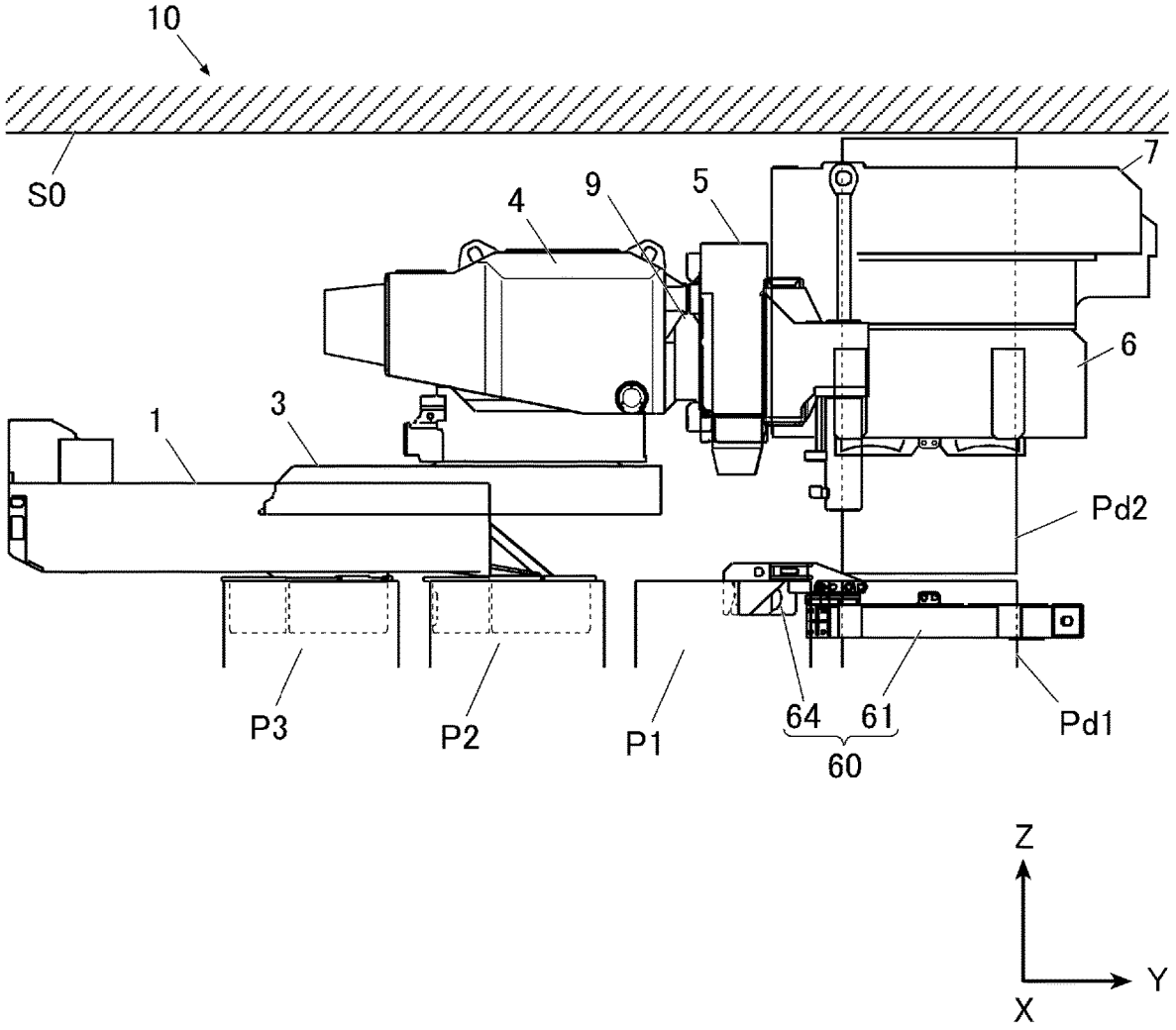
FIG. 17 This is a step view for the pile press-in construction method for divided piles, continuing from FIG. 16.

FIG. 15 through FIG. 17 are step views for illustrating, in order, a pile press-in construction method for divided piles Pd using the holding chuck attachment 60. A pile press-in operation is described with reference to these drawings.

As illustrated in FIG. 15, description is given from a state in which the pile press-in device 10 has gripped the upper end of the existing piles P2 and P3 by the clamp devices 2F and 2R, made the chuck device 6 enter a laid-sideways state on the side of the pile row P1, P2, P3, . . . , and the divided pile Pd1 has been supplied to the chuck device 6 from the pile supplying device 30 (may be a crane if possible).

When pressing in the divided pile Pd1 (press-in pile) which will be in the lead (will be the deepest section) of the pressing in, the holding chuck attachment 60 is in a state of having been mounted in advance to the bottom of the chuck frame 7 via the bracket 66. The holding chuck attachment 60 is grasped by the chuck device 6 in a state where the divided pile Pd1 has been movably inserted into the frame body 61 belonging to the holding chuck attachment 60. Note that, at this time here, each grasping mechanism 62 is not grasping the divided pile Pd1.

Next, a stroke operation by the slide base 3 is used to convey the divided pile Pd1 to a press-in position that is set as a target and is on the front side of the existing pile P1, and turning of the mast 4 is used to move the chuck device 6 to the front side of the mast 4. Furthermore, as illustrated in FIG. 16, tilting of the chuck device 6 by the chuck tilting mechanism 9 is used to achieve a press-in orientation in which the grasping central axis CZ is in the press-in direction (up-down direction).

At this time, when the holding chuck attachment 60 is attached to the existing pile P1 first, the lower end of the divided pile Pd1 interferes with the holding chuck attachment 60 when making the chuck device 6 achieve the press-in orientation. Accordingly, the divided pile Pd1 must have a length that does not interfere with the holding chuck attachment 60.

However, the holding chuck attachment 60 is mounted to the bottom of the chuck frame 7, whereby interference with the divided pile Pd1 is avoided, and it becomes possible to select a longer divided pile Pd1 even in an environment in which a height limitation S0 is present. For example, for the divided pile Pd1, it is possible to select one having a length close to the height from the ground to the height limitation S0.

While the raising and lowering device 5 is performing a stroke operation in a descending direction, the chuck device 6 rotates and presses in the divided pile Pd1.

As a result, the holding chuck attachment 60 descends together with the chuck frame 7, and the tube wall of the existing pile P1 enters the slit 641 of each securing clamp device 64.

At this stage, the rotation of the divided pile Pd1 and lowering of the chuck frame 7 is paused, and the securing clamp devices 64 are used to secure the holding chuck attachment 60 to the pile head of the existing pile P1. The connecting pins are pulled out, and the holding chuck attachment 60 is caused to separate from the chuck frame 7 (transfer step).

Subsequently, the pile press-in device 10 performs rotary pressing-in of the divided pile Pd1 and upward movement of the grasping position in accordance with the chuck device 6 one or more times, and when pressing in is performed to a height where it is possible for the holding chuck attachment 60 to grasp the upper section of the divided pile Pd1, the holding chuck attachment 60 uses each grasping claw 621 to grasp the upper section of the divided pile Pd1.

Regarding the pile press-in device 10, the chuck device 6 releases the divided pile Pd1, enters the laid-sideways state in which the chuck device 6 is to the side of the pile row P1, P2, P3, . . . , performs a rearward movement, and is supplied with the next divided pile Pd2.

Subsequently, the divided pile Pd2 is conveyed to above the divided pile Pd1 and, as illustrated in FIG. 17, the divided pile Pd2 is set to a press-in orientation above the divided pile Pd1.

Note that, below the second and subsequent divided piles Pd, there are the holding chuck attachment 60 which is secured to the existing pile P1 as well as the preceding divided piles Pd. Therefore, in order to avoid interference with these, piles having a length that is shorter than the leading divided pile Pd1 are used for the second and subsequent divided piles Pd.

However, the holding chuck attachment 60 can be secured to an existing pile P. Therefore, it is possible to dispose the holding chuck attachment 60 at a lower position in comparison to a case where the holding chuck attachment 60 is always held at the side of the pile press-in device. Accordingly, when the holding chuck attachment 60 is used, it is possible to use longer piles for the second and subsequent divided piles Pd.

Meanwhile, the divided pile Pd2, which has entered the press-in orientation together with the chuck device 6, is connected to the upper end of the divided pile Pd1. The divided pile Pd1 and the divided pile Pd2 may be connected using, for example, welding. In addition, when the divided pile Pd1 and the divided pile Pd2 have mechanical joints, these may be used to connect the divided pile Pd1 and the divided pile Pd2.

The mechanical joints are provided with an uneven structure on one and the other of the divided pile Pd1 and the divided pile Pd2, and connecting is performed by causing these to fit. For example, a curved groove that curves in a circumferential direction from partway is provided facing a pile longitudinal direction from a pile end on one divided pile Pd, and a fitting protrusion that fits with the curved groove is provided on the other divided pile Pd. Such that the fitting protrusion follows the curved groove, the other divided pile Pd is caused to move in the pile longitudinal direction and then caused to rotate, whereby the fitting protrusion reaches the deepest section of the curved groove, and it is possible to connect the divided piles Pd to each other.

The pile press-in device 10 can use a stroke operation by the raising and lowering device 5 and a rotational operation by the chuck device 6 to suitably connect divided piles Pd, which have mechanical joints, to each other.

When the divided pile Pd1 and the divided pile Pd2 are connected, the divided pile Pd1 is released from the grasping state by the holding chuck attachment 60, and subsequently the divided pile Pd1 and the divided pile Pd2 are integrated together and are subjected to rotary pressing-in.

An operation similar to that for the divided pile Pd2 is repeated for divided piles Pd thereafter.

When the final (topmost) divided pile Pd is subjected to rotary pressing-in and the top edge thereof is aligned with that of the existing pile P1 (height adjustment), the final divided pile Pd is released from the chuck device 6.

In addition, the holding chuck attachment 60 is connected to the bottom of the chuck frame 7 by the bracket 66, and is recovered (recovery step).

Note that the recovery step for connecting the holding chuck attachment 60 to the pile press-in device 10 may not be after completely pressing in the last divided pile Pd. If a state is entered in which any divided pile Pd, which corresponds to a press-in pile, is stably erected in the ground due to being pressed in, the holding chuck attachment 60 may be connected to the pile press-in device 10 and recovered at any subsequent timing.

In this manner, in the pile press-in method described above, the holding chuck attachment 60 can clamp onto the upper end of the existing pile P1 to thereby be secured to the existing pile P1. Therefore, it is easier to dispose the holding chuck attachment 60 at a lower position in comparison to a case of being held by the pile press-in device 10. Accordingly, it becomes possible to use and press in a divided pile Pd that is longer than conventional ones when interference with the holding chuck attachment 60 is considered.

In addition, the holding chuck attachment 60 can be mounted to the pile press-in device 10 in a state of not being clamped to the upper end of the existing pile P1. Accordingly, the holding chuck attachment 60 is mounted to the pile press-in device 10 when the leading divided pile Pd1 is being pressed in, whereby it becomes possible to use a longer divided pile Pd1.

[Performing Pile Press-In Construction Method (3)]

Description is given below regarding a pile press-in construction method (inter-pile water cutoff construction method) for performing pile press-in of a small-diameter pile Ps using a grasping attachment unit 70 in the pile press-in device 10 already described.

The pile press-in construction method (inter-pile water cutoff construction method) for the small-diameter pile Ps is a construction method for cutting-off water between piles by pressing in small-diameter piles Ps having a smaller diameter than that of existing piles P at positions where there is a recess shape between piles in plan view such that gaps that arise between piles are blocked in the pile row P1, P2, P3, . . . of existing piles described above.

Figure 18:
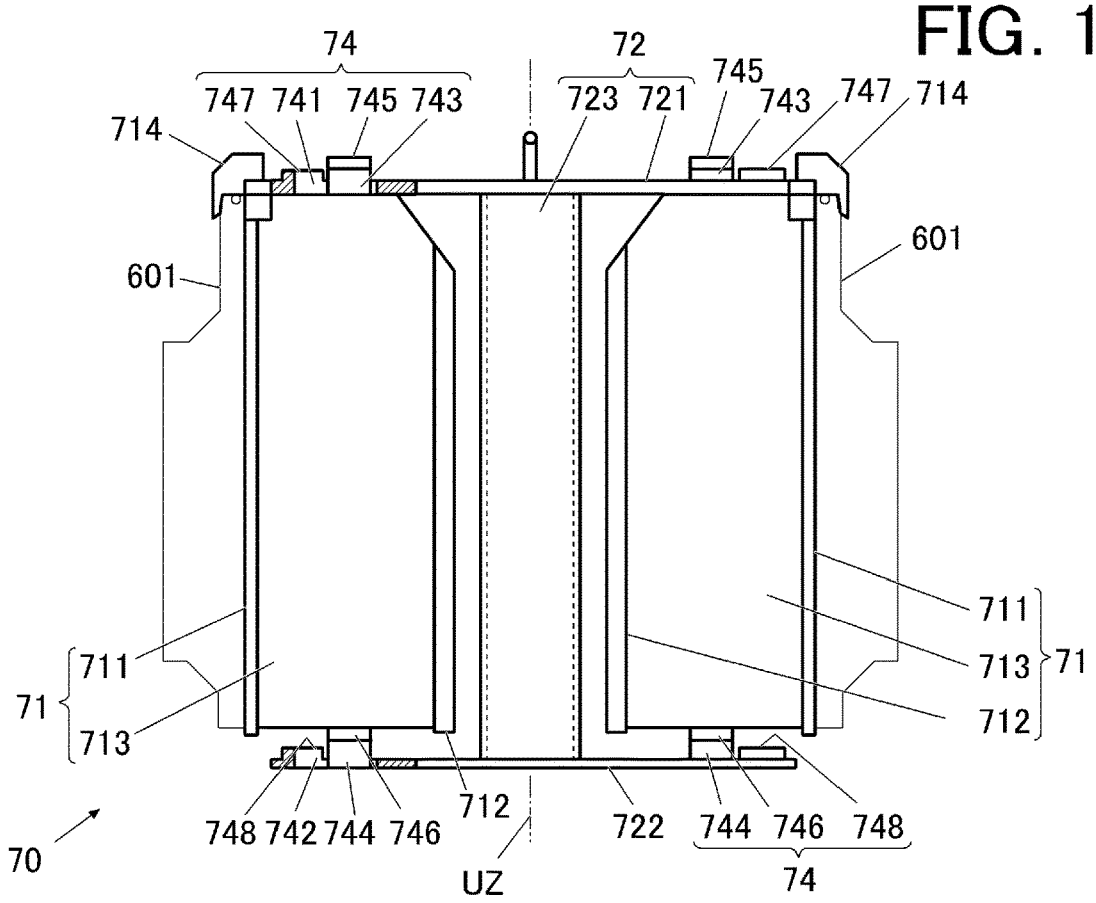
FIG. 18 This is a front view of a grasping attachment unit in an orientation for a time of usage.
Figure 19:
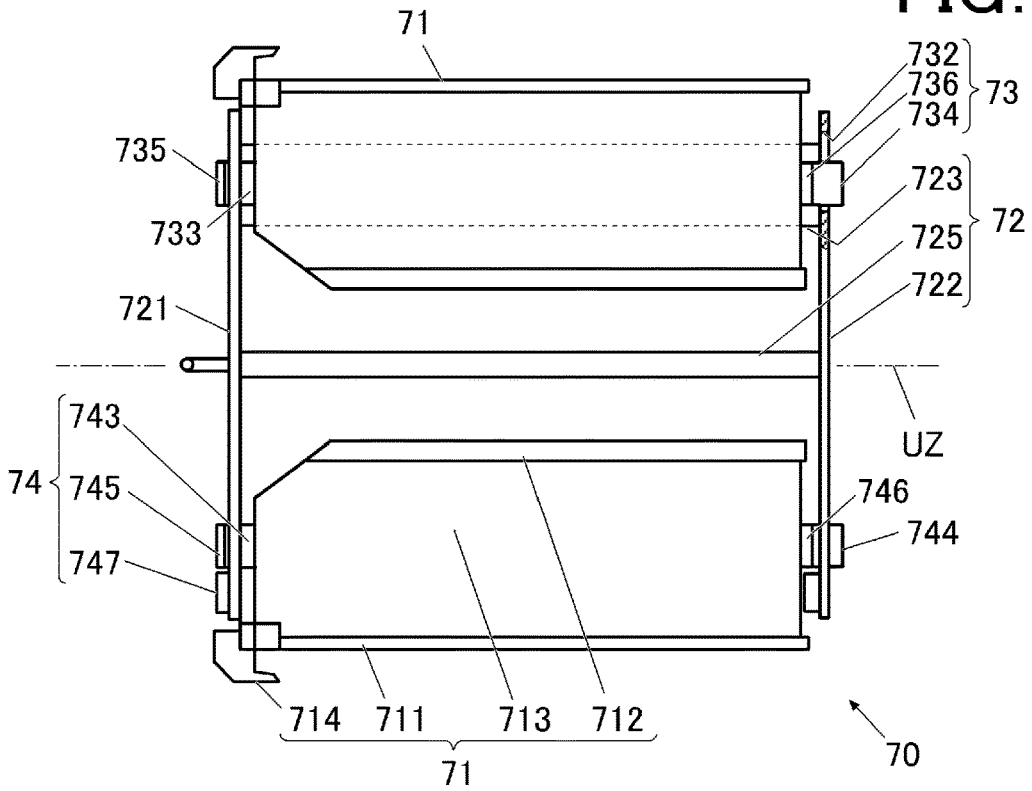
FIG. 19 This is a front view of the grasping attachment unit in a laid-sideways state.
Figure 20:
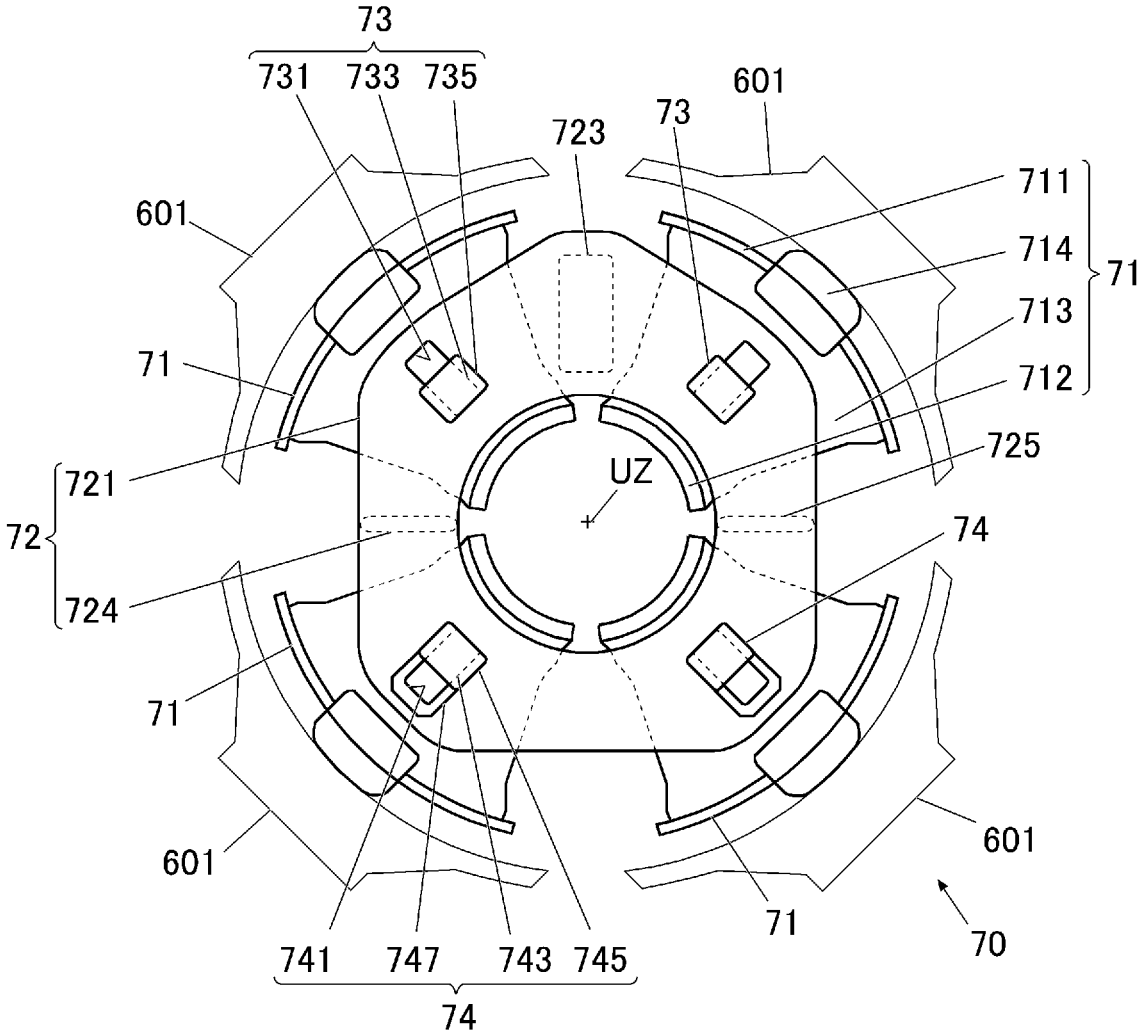
FIG. 20 This is a plan view of the grasping attachment unit in the laid-sideways state.
Figure 21:
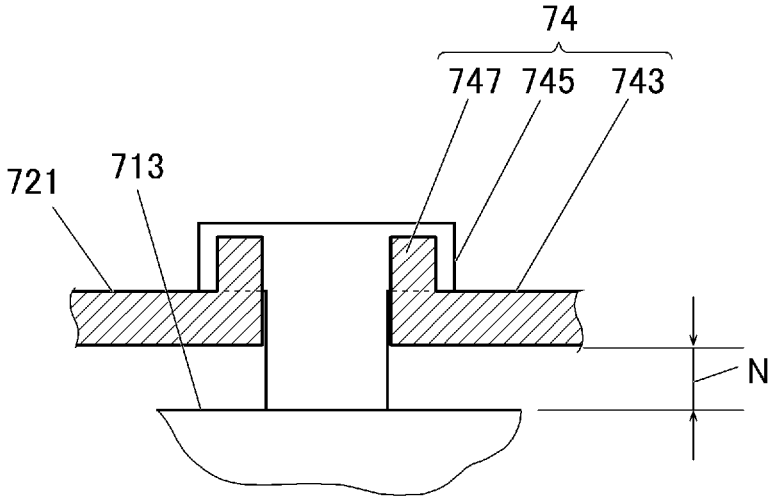
FIG. 21 This is a cross-sectional view of a support mechanism, illustrating a state in which a restricting protrusion has restricted movement by a grasping attachment.
Figure 22:
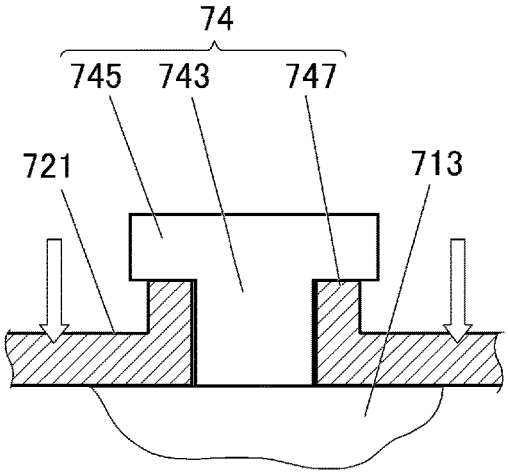
FIG. 22 This is a cross-sectional view of the support mechanism, illustrating a state in which the restricting protrusion has released restricting movement by the grasping attachment.
Figure 23:
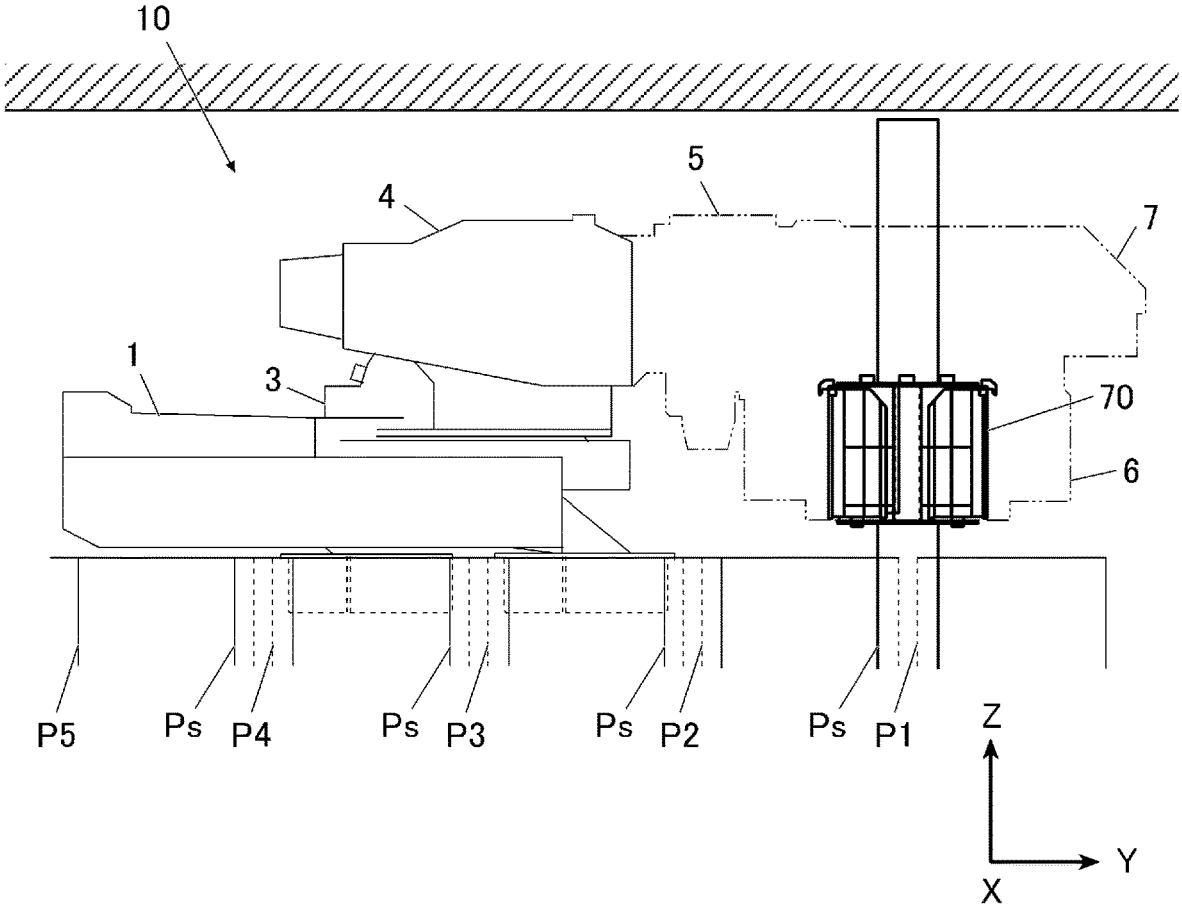
FIG. 23 This is an explanatory view for a usage state for the grasping attachment unit which is mounted to the pile press-in device.

FIG. 18 is a front view of the grasping attachment unit 70 in an orientation at a time of usage (erect state), FIG. 19 is a front view of the grasping attachment unit 70 in laid-sideways state, FIG. 20 is a plan view of that in the laid-sideways state, FIG. 21 and FIG. 22 are cross-sectional views of a support mechanism 74 that is described below, and FIG. 23 is an explanatory view of the grasping attachment unit 70 which is mounted to the pile press-in device 10 in a usage state.

The grasping attachment unit 70 has: four grasping attachments 71 that are individually mounted to grasping surfaces of a plurality of (for example, four) grasping members 601 that belong to the chuck device 6 and performs grasping and releasing by a gathering/dispersing operation with respect to the pile P, the four grasping attachments 71 performing a gathering/dispersing operation together with the grasping members 601; and a bracket 72 that supports these in a manner that enables the gathering/dispersing operation.

The bracket 72, in a laid-sideways state, restricts movement in a dispersion direction in the gathering/dispersing operation with respect to at least a grasping attachment 71 positioned on one side of a grasping central axis UZ and, in a state where the grasping central axis UZ is erected, releases restriction of movement in the dispersion direction.

The grasping central axis UZ of the above-described grasping attachment unit 70 is an axis that vertically passes through the center of the four grasping attachments 71, and is on the same axis as the grasping central axis CZ in a state where the grasping attachment unit 70 is grasped by the chuck device 6.

The four grasping attachments 71 are disposed on the same circumference which is centered on the grasping central axis UZ. Each grasping attachment 71 has a back surface plate 711 that comes into contact with the grasping surface of a grasping member 601, a grasping plate 712 that faces the grasping central axis UZ side, and a body block 713 that supports the back surface plate 711 and the grasping plate 712.

The back surface plate 711 is a circumferential plate that follows the grasping surface of the grasping member 601, and it is possible to cause approximately the entirety of the surface thereof that is on the radially outward side with respect to the grasping central axis UZ to come into contact with the grasping surface.

Provided on the upper end of the back surface plate 711 is a latching claw 714, which protrudes on the radially outward side with respect to the grasping central axis UZ and has a protruding tip facing downward. The upper end of the grasping member 601 is inserted from the lower side of this latching claw 714, whereby it is possible to enter a mounting state in which the entirety of the grasping attachment 71 is latched to the grasping member 601 using dead weight.

The grasping plate 712 is a plate that follows a circumference around the grasping central axis UZ, and grasps by the surface thereof on the grasping central axis UZ side coming into contact with an outer peripheral surface of a small-diameter pile Ps.

The body block 713 supports the back surface plate 711 and the grasping plate 712, and is supported by the bracket 72 in a manner that enables movement along a radial direction with respect to the grasping central axis UZ.

As a result, the grasping attachments 71, together with the grasping members 601, can perform a gathering/dispersing operation with respect to the grasping central axis UZ, grasp and release the small-diameter pile Ps, and perform rotary pressing-in of the small-diameter pile Ps.

The bracket 72 has an upper bracket 721 and a lower bracket 722 that respectively support an upper end and a lower end of each grasping attachment 71, and support columns 723-725 that integrally connect with these at predetermined intervals in the up-down direction.

The upper bracket 721 and the lower bracket 722 each have a flat plate shape, and an opening into which the small-diameter pile Ps can be movably inserted is formed at the center of each.

Each of the support columns 723-725 is somewhat longer in the up-down direction than each grasping attachment 71. Accordingly, it is possible to form gaps to a certain level between the upper ends of the grasping attachments 71 and the bottom surface of the upper bracket 721, and between the lower ends of the grasping attachments 71 and the top surface of the lower bracket 722.

In addition, support mechanisms 73 and 74 that enables movement in the gathering/dispersing operation of the grasping attachments 71 are provided between the bracket 72 and the grasping attachments 71.

The support mechanisms 73 are provided around the grasping central axis UZ between the bracket 72 and two grasping attachments 71 on the support column 723 side, and the support mechanisms 74 are provided around the grasping central axis UZ between the bracket 72 and two grasping attachments 71 on the opposite side to the support column 723.

Each support mechanism 73 has guide holes 731 and 732 that have an elongated hole shape and respectively penetrate the upper bracket 721 and the lower bracket 722, ridge sections 733 and 734 that protrude from the upper end and lower end of a grasping attachment 71 and are inserted into the guide holes 731 and 732, and widened sections 735 and 736 that are extended to the left and right at the upper end of the ridge sections 733 and 734.

Each of the guide holes 731 and 732 is formed along the radial direction with respect to the grasping central axis UZ, and guide the ridge sections 733 and 734 along the same direction. The ridge section 733 is inserted into the guide hole 731 from below, and the widened section 735 is positioned on the upper side from the upper bracket 721. The ridge section 734 is inserted into the guide hole 732 from above, and the widened section 736 is positioned on the upper side from the lower bracket 722.

In addition, the support mechanisms 74 have guide holes 741 and 742, ridge sections 743 and 744, and widened sections 745 and 746 with the same structure as those in the support mechanisms 73, and, on the dispersion direction side in a gathering/dispersing operation at the guide holes 741 and 742, are provided with restricting protrusions 747 and 748 for restricting movement by the ridge sections 743 and 744.

The restricting protrusions 747 and 748 are ridges that protrude upward on portions on the dispersion direction side of both guide holes 741 and 742, come into contact with the widened sections 745 and 746, and restrict movement by the ridge sections 743 and 744 (grasping attachments 71) toward the dispersion direction side.

However, as illustrated in FIG. 21, a gap N of a certain level is provided between the upper end of a grasping attachment 71 and the bottom surface of the upper bracket 721. Accordingly, as illustrate in FIG. 22, when the bracket 72 moves downward with respect to the grasping attachment 71, the widened sections 745 and 746 can move upward relatively, go over the restricting protrusions 747 and 748, and cause the ridge sections 743 and 744 (grasping attachment 71) to move toward the dispersion direction side.

Description is given in step order for the pile press-in construction method (inter-pile water cutoff construction method) for performing pile press-in of a small-diameter pile Ps using the grasping attachment unit 70 having the configuration described above.

The pile press-in device 10 grips the upper ends of the existing piles P3 and P4 by the clamp devices 2F and 2R and makes the chuck device 6 enter the laid-sideways state, and the grasping attachment unit 70, which is in the laid-sideways state, is inserted inside of the grasping members 601 of the chuck device 6 from the pile supplying device 30 (may be a crane if possible).

At this time, the grasping attachment unit 70 is inserted into the chuck device 6 after being made to enter the laid-sideways state in which the support column 723 belonging to the bracket 72 faces the upper side, as illustrated in FIG. 19.

As a result, the two grasping attachments 71 supported by the support mechanisms 73 are on the upper side, and the two grasping attachments 71 supported by the support mechanisms 74 are on the lower side.

The grasping attachments 71 supported by the support mechanisms 73 move toward the grasping central axis UZ side due to the dead weight thereof, and the grasping attachments 71 supported by the support mechanisms 74 receive a load on the radially outward side (downward) due to the dead weight thereof, but are kept on the grasping central axis UZ side by the restricting protrusions 747 and 748.

Accordingly, it is possible to perform insertion into the chuck device 6 in a state where all the grasping attachments 71 are gathered on the grasping central axis UZ side.

When all support mechanisms are configured by support mechanisms 73 that lack the restricting protrusions 747 and 748, the two grasping attachments 71 on the lower side would move to the radially outward side due to the dead weight thereof, and thus it would be difficult to insert the two grasping attachments 71 on the lower side into the chuck device 6 due to interference with the grasping members 601. Contact therebetween could be a cause of scratching or damage, but it is possible to suppress and reduce this by providing the support mechanisms 74.

When the grasping attachment unit 70 is inserted in a state where the grasping members 601 belonging to the chuck device 6 are made to be near the back surface plates 711 of the grasping attachments 71, a state is entered in which the upper ends of the grasping members 601 are inserted inside the latching claws 714, and the grasping members 601 are connected to the grasping attachments 71.

The chuck device 6 is caused to tilt from this state and, when the grasping attachment unit 70 enters the erect state, the bracket 72, due to the dead weight thereof, makes a downward movement equivalent to the gap N, with respect to the grasping attachments 71 connected to the grasping members 601, as illustrated in FIG. 18. As a result, the restricting protrusions 747 and 748 descend from the state in FIG. 21 and enter a state in FIG. 22 in which the restricting is released, and thus all of the grasping attachments 71 can perform the gathering/dispersing operation.

In this state, the chuck device 6 is set to the laid-sideways state again, and the pile supplying device 30 (or a crane) is used to insert the small-diameter pile Ps inside the grasping attachment unit 70, and the small-diameter pile Ps is grasped by the grasping members 601 and the grasping attachments 71.

A subsequent rotary press-in operation for the small-diameter pile Ps is the same as the case for a pile P. However, in the case of small-diameter piles Ps, because the small-diameter piles Ps are pressed in at positions shifted in the left-right direction from the center of each pile P from among the pile row P1, P2, P3, . . . , the rotary press-in work is performed by causing the mast 4 to turn somewhat around the mast pivot MZ, and adjusting the position of the chuck device 6 in the left-right direction.

In addition, in a case of performing pile press-in construction in an environment where a height limitation S0 is present, divided piles (press-in piles) are used for the small-diameter pile Ps. In this case, the pile press-in construction is performed while alternatingly pressing in a divided pile (press-in pile) for the small-diameter pile Ps and using longitudinal joining to join divided piles (press-in piles) to each other.

By using the grasping attachment unit 70 described above, the pile press-in device 10 can perform rotary pressing-in of a small-diameter pile Ps, which has a small diameter that cannot be grasped by the chuck device 6. The grasping attachment unit 70 can use the support mechanisms 74 to restrict the grasping attachments 71 moving in the dispersion direction in the laid-sideways state, and enable work for equipping the grasping attachment unit 70 to the chuck device 6 to be performed easily and smoothly.

Note, in the embodiment described above, the grasping attachment unit 70 that has the support mechanisms 74 which have the restricting protrusions 747 and 748 and has the support mechanisms 73 which lack restricting protrusions was exemplified, but there is no limitation to this, and all the grasping attachments 71 may be configured to be provided with the support mechanisms 74.

[Proposal Relating to Invention of Holding Chuck Attachment]

The embodiment set forth in performing pile press-in construction method (2) and FIG. 13 through FIG. 17 described above relates to a holding chuck attachment and a pile press-in construction method that uses this, and these are industrially applicable.

Background Art for Embodiment Described Above

A pile press-in device described in Japanese Patent No. 6854939 can generate a reaction force by gripping the upper ends of existing piles which have been pressed into the ground, grasp a pile, press the pile into the ground, and successively press in piles while moving on a pile row formed by the existing piles to thereby extend the pile row on the ground.

Incidentally, there are cases in which pressing in of an articulated pile resulting from connecting a plurality of piles is performed. Regarding work for pressing in this articulated pile, press-in work is performed while performing connecting by repeatedly pressing in a pile that is to be connected and joining (connecting) the new pile.

For the purpose of work for pressing in an articulated pile, a conventional pile press-in device is provided with, below a chuck device for grasping a pile, a sub chuck that can grasp a preceding pile, holds an upper end of the preceding pile by the sub chuck, mutually connects the next pile in a state where the next pile is grasped by the chuck device (joining work), and presses in the integrated piles.

Problem in Embodiment Described Above

However, because the sub chuck is disposed below the chuck device in the pile press-in device described above, there is a problem in that only a pile having a shorter length can be used in order to avoid interference with the sub chuck.

A solution described below is made in the light of the above problem in the prior art, and addresses the problem of pressing in a longer pile in a case of performing pressing in after connecting piles.

Solution to Problem

A first solution for solving the above problem is a holding chuck attachment that holds, when a pile press-in device that generates a reaction force by gripping an upper end of an existing pile is used to connect press-in piles with each other by longitudinal joining and to press the press-in piles into the ground, an upper section of one of the press-in piles, the holding chuck attachment including:

a securing clamp device that clamps onto the upper end of the existing pile to thereby secure the holding chuck attachment to the existing pile; and a holding chuck device that grasps the upper section of the one of the press-in piles.

A second solution is the holding chuck attachment according to the first solution including a section to be connected that is connectable to and separable from the pile press-in device.

A third solution is the holding chuck attachment according to the first solution including an adjustment mechanism that adjusts an interval between the securing clamp device and the holding chuck device.

A fourth solution is the holding chuck attachment according to the first solution, in which the securing clamp device has a slit into which a plate-shaped portion of the upper end of the existing pile is inserted from below.

A fifth solution is the holding chuck attachment according to the first solution, in which the holding chuck device that is secured to the existing pile with the securing clamp device is at a lower position than the securing clamp device.

A sixth solution is a pile press-in construction method that uses the holding chuck attachment according to the second solution to connect press-in piles with each other by longitudinal joining and to press the press-in piles into the ground, the pile press-in construction method including pile connecting in which one of the press-in piles and another of the press-in piles are connected upon the holding chuck attachment that clamps the upper end of the existing pile and is secured to the existing pile grasping an upper section of the one of the press-in piles.

A seventh solution is the pile press-in construction method according to the sixth solution, including, before the pile connection, transferring in which the pile press-in device to which the holding chuck attachment is attached disposes the one of the press-in piles at a target position of press in and transfers the holding chuck attachment to the upper end of the existing pile before start of the press in or partway through the press in.

An eighth solution is the pile press-in construction method according to the sixth or seventh solution, including recovering of the holding chuck attachment by connection of the holding chuck attachment to the pile press-in device before or after completion of pressing in of the last press-in pile of press-in piles that are connected by longitudinal joining and configure an articulated pile.

Effect of Solution

By virtue of the solutions described above, it is possible to press in a longer pile in a case of performing pressing in after connecting piles.

INDUSTRIAL APPLICABILITY

The present invention is industrially applicable in relation to a pile press-in construction method, a pile supplying device, and a pile press-in device.

REFERENCE SIGNS LIST

P (P0-P4) Pile (steel pipe pile)
1 Saddle
2F, 2R Clamp device
3 Slide base
4 Mast
5 Raising and lowering device
6 Chuck device
7 Chuck frame
9 Chuck tilting mechanism
10 Pile press-in device
20 Pile transporting device
30 Pile supplying device
30A Pickup arm
31 Swing arm
32, 33 Hinged connector
34 Fork
34*a*, 34*b* Prong
40 Barge

The invention claimed is:

1. A pile press-in construction method using a pile press-in device that is provided with a saddle, a clamp device that is provided at the bottom of the saddle and configured to grasp an upper end of an existing pile that has been pressed into the ground, a mast erected in a turnable manner on the saddle, a raising and lowering device, and a chuck device that is supported by the mast via the raising and lowering device and is configured to hold a pile, the pile press-in device configured to generate a reaction force by gripping, with the clamp device, the upper end of the existing pile that has been pressed into the ground, holding the pile by the chuck device, pressing the pile into the ground by operating the raising and lowering device, and successively pressing in piles while moving on a pile row including the existing pile to thereby extend the pile row on the ground, the pile press-in construction method comprising:

employing, as the pile press-in device, a pile press-in device in which the chuck device is tiltable about a chuck tilting axis that intersects with the mast and is in a direction in which the mast and the chuck device line up;

supplying the pile in the chuck device by causing the chuck device to be laid sideways and to project outward to a side of the pile row as viewed from an axial direction of the existing pile by turning the mast and tilting the chuck device, causing the chuck device to face a direction in which an insertion direction of the pile with relation to the chuck device is a horizontal direction along the pile row, laying the pile sideways, supplying the pile, inserting the pile into the chuck device, and causing the chuck device to grasp the pile;

transitioning an orientation of the pile to press the pile into the ground by turning the mast and tilting the chuck device; and pressing the pile into the ground.

2. The pile press-in construction method according to claim 1, wherein, in supplying the pile in the chuck device, the pile is inserted into the chuck device from behind in a direction in which the pile row extends.

3. The pile press-in construction method according to claim 1, wherein, in supplying the pile in the chuck device, the pile is inserted into the chuck device from in front in a direction in which the pile row extends.

4. The pile press-in construction method according to claim 1, wherein the pile press-in device includes a slide base that is horizontally movable on the saddle, the mast is erected on the slide base in a turnable manner, and in supplying the pile in the chuck device, an insertion length of the pile into the chuck device is increased upon a stroke of the slide base.

5. The pile press-in construction method according to claim 4, wherein the raising and lowering device of the pile press-in device is tiltable about the chuck tilting axis together with the chuck device, and in supplying the pile in the chuck device, an insertion length of the pile into the chuck device is increased upon a stroke of the raising and lowering device.

6. The pile press-in construction method according to claim 2, wherein a pile press-in device in which the mast is tiltable such that the chuck device moves up and down is employed as the pile press-in device, and in a part or all of the inserting of the pile into the chuck device in supplying the pile in the chuck device, the mast is caused to tilt such that a height of a grasping central axis of the chuck device in a laid-sideways state is adjusted.

7. The pile press-in construction method according to claim 1, in which a pile formed by a plurality of divided piles being connected in a longitudinal direction is pressed into the ground, the pile press-in construction method comprising:

pile connecting of a next divided pile including holding, with a holding chuck attachment that clamps an upper end of an existing pile and is secured to the existing pile, an upper end of one of the divided piles that is a leading pile at a time of pressing in.

8. The pile press-in construction method according to claim 1, wherein the chuck device has a plurality of grasping members that are configured to perform a gathering/dispersing operation with respect to the pile, and a pile having a grasped dimension smaller than a grasped dimension that the chuck device can grasp is grasped and pressed in with a grasping attachment unit, the grasping attachment unit having a plurality of grasping attachments and a bracket, the plurality of grasping attachments being mounted to grasping surfaces of the grasping members and performing a gathering/dispersing operation together with the grasping members, the bracket restricting movement of at least one of the grasping attachments that is on one side around a grasping central axis into a dispersion direction in the gathering/dispersing operation upon the grasping central axis being laid horizontally, the bracket releasing restriction of movement in the dispersion direction upon the grasping central axis being erected.

* * * * *